US008411028B2

(12) United States Patent
Yamada

(10) Patent No.: US 8,411,028 B2
(45) Date of Patent: Apr. 2, 2013

(54) ELECTROPHORETIC DISPLAY DEVICE DRIVING CIRCUIT, ELECTROPHORETIC DISPLAY DEVICE, AND ELECTRONIC APPARATUS

(75) Inventor: Toshimichi Yamada, Suwa (JP)

(73) Assignee: Seiko Epson Corporation (JP)

( * ) Notice: Subject to any disclaimer, the term of this patent is extended or adjusted under 35 U.S.C. 154(b) by 714 days.

(21) Appl. No.: 12/361,752

(22) Filed: Jan. 29, 2009

(65) Prior Publication Data

US 2009/0237350 A1 Sep. 24, 2009

(30) Foreign Application Priority Data

Mar. 18, 2008 (JP) ..... 2008-070080
Oct. 23, 2008 (JP) ..... 2008-273105

(51) Int. Cl.
*G09G 3/34* (2006.01)

(52) U.S. Cl. ..... 345/107

(58) Field of Classification Search ..... 345/107
See application file for complete search history.

(56) References Cited

U.S. PATENT DOCUMENTS

2006/0033744 A1* 2/2006 Perez ..... 345/502
2008/0278472 A1* 11/2008 Huitema et al. ..... 345/212
2009/0051863 A1* 2/2009 Meisner ..... 349/143

FOREIGN PATENT DOCUMENTS

JP 2003-84314 3/2003
JP 2007-121699 5/2007
WO WO 2005093704 A1 * 10/2005

* cited by examiner

*Primary Examiner* — Adam R Giesy
(74) *Attorney, Agent, or Firm* — Harness, Dickey & Pierce, P.L.C.

(57) ABSTRACT

An electrophoretic display device driving circuit that drives an electrophoretic display device. The electrophoretic display device includes a display unit that includes a plurality of pixels, each of which includes an electrophoretic element, containing electrophoretic particles, that is provided between a pixel electrode and a common electrode that face each other; a pixel switching element; a memory circuit to which an image signal may be written through the pixel switching element; and a switch circuit that controls switching of the pixel electrode in accordance with an output based on the image signal in the memory circuit. The electrophoretic display device driving circuit includes: a low-speed clock supply unit that supplies a low-speed clock; a high-speed clock supply unit that supplies a high-speed clock having a frequency higher than that of the low-speed clock; and a control unit that (i) controls writing of the image signal to the memory circuit on the basis of the high-speed clock, and that (ii) controls an operation including supply of a predetermined pixel potential to the pixel electrode through the switching control on the basis of the low-speed clock.

11 Claims, 10 Drawing Sheets

ELECTROPHORETIC DISPLAY DEVICE DRIVING CIRCUIT, ELECTROPHORETIC DISPLAY DEVICE, AND ELECTRONIC APPARATUS

BACKGROUND

1. Technical Field

The invention relates to a technical field of an electrophoretic display device driving circuit that drives an electrophoretic display device, an electrophoretic display device, and an electronic apparatus.

2. Related Art

An electrophoretic display device of this type includes a display unit that displays an image in the following manner with a plurality of pixels. In each pixel, after an image signal is written to a memory circuit through a pixel switching element, a pixel electrode is driven by a pixel potential corresponding to the written image signal to thereby generate a potential difference with respect to a common electrode. This drives an electrophoretic element between the pixel electrode and the common electrode to perform display. For example, JP-A-2003-84314 describes a configuration that the pixel includes a DRAM (Dynamic Random Access Memory) in a memory circuit. In this case, writing of an image signal in the memory circuit and supply of a pixel potential to the pixel electrode are simultaneously performed in parallel with each other.

According to the configuration of the above described display unit, supply of image signals to the plurality of pixels that are arranged in a matrix of rows and columns typically needs to be controlled on the basis of a high-frequency high-speed clock. Thus, a controller (or a driving unit) for performing that control needs to be driven on the basis of a high-speed clock. Because power consumption during operation depends on the frequency of clock, there occurs inconvenience that power consumption of the controller increases. Thus, it is difficult to use a simple secondary battery, or the like, and, therefore, there may be a problem that supply of electric power for driving the electrophoretic display device becomes complex.

SUMMARY

An advantage of some aspects of the invention is that it provides an electrophoretic display device driving circuit, electrophoretic display device and electronic apparatus that are able to reduce power consumption.

An aspect of the invention provides a first electrophoretic display device driving circuit that drives an electrophoretic display device. The electrophoretic display device includes a display unit that includes a plurality of pixels, each of which includes an electrophoretic element, containing electrophoretic particles, that is provided between a pixel electrode and a common electrode that face each other; a pixel switching element; a memory circuit to which an image signal may be written through the pixel switching element; and a switch circuit that controls switching of the pixel electrode in accordance with an output based on the image signal in the memory circuit. The electrophoretic display device driving circuit includes: a low-speed clock supply unit that supplies a low-speed clock; a high-speed clock supply unit that supplies a high-speed clock having a frequency higher than that of the low-speed clock; and a control unit that (i) controls writing of the image signal to the memory circuit on the basis of the high-speed clock, and that (ii) controls an operation including supply of a predetermined pixel potential to the pixel electrode through the switching control on the basis of the low-speed clock.

In the electrophoretic display device driven by the first driving circuit according to the aspect of the invention, by applying a voltage based on a potential difference between the pixel electrode and the common electrode in each of the plurality of pixels included in the display unit, the electrophoretic particles contained in the electrophoretic element provided between the pixel electrode and the common electrode are moved between the pixel electrode and the common electrode to thereby display an image on the display unit. In each pixel, prior to image display, (i) an image signal is supplied and written through the pixel switching element to the memory circuit, and other than the above (i), (ii) switching of the pixel electrode is controlled by the switch circuit so that the pixel electrode is supplied with a predetermined pixel potential in accordance with the output based on the image signal from the memory circuit to thereby perform image display. Note that prior to the predetermined image display, image deletion in which a previous image that has been already displayed on the display unit is deleted may be performed. In this case, at least as in the case of the operation according to the image display, each pixel is supplied through the switch circuit with a pixel potential, for example, the same potential as the previous image display or a different potential for inverting grayscale as portion of the operation including the image display of the above (ii).

The first driving circuit according to the aspect of the invention includes the control unit that includes a controller that controls the operations of the above (i) and (ii) on the basis of the high-speed clock supplied from the high-speed clock supply unit and the low-speed clock supplied from the low-speed clock supply unit. The control unit writes image signals to the plurality of pixels on the basis of the high-speed clock in regard to the above (i) and supplies the predetermined pixel potential to the pixel electrodes on the basis of the low-speed clock in regard to the above (ii). In regard to the above (i), in order to quickly write the image signals typically by sequentially selecting the plurality of pixels horizontally and vertically, it is necessary to control that operation on the basis of the high-speed clock. In the above (ii), that is, to perform image display or image deletion, the pixel potentials are supplied through common control lines to the pixels arranged horizontally or vertically. Thus, in order to supply the pixel potentials in units of pixel row or in units of pixel column, it is sufficient to control that operation on the basis of the low-speed clock having a frequency lower than that of the above (i). Alternatively, as other operation included in the above (ii), for example, when the display unit or various circuits are started up to switch display through key input of next page, previous page, or the like, of an electronic paper, or the like, it is sufficient that the standby mode in which an instruction through key input, or the like, is waited and start-up of the display unit, and the like, are controlled on the basis of the low-speed clock.

In the first driving circuit according to the aspect of the invention, the control unit controls the operation of image display, or the like, of the above (ii) on the basis of the low-speed clock other than the operation of the above (i) that requires control based on the high-speed clock. Thus, as described above, in comparison with the case in which various control is regularly driven only on the basis of the high-speed clock, it is possible to reduce power consumption. Thus, it is possible to drive the electrophoretic display device at relatively low electric power and, therefore, it is possible to use a simple secondary battery, or the like.

In the aspect of the first electrophoretic display device driving circuit according to the invention, a power supply unit that supplies the pixel potential to the display unit and supplies a common potential to the common electrode in synchronization with the supply of the pixel potential may be provided, wherein the control unit may control supply of the pixel potential and the common potential by the power supply unit on the basis of the low-speed clock.

According to the above aspect, the power supply unit supplies the pixel potential to each of the plurality of pixels in the display unit in image display or image deletion of the above (ii) and, in synchronization with this, supplies the common potential to the common electrode. The common potential is supplied through a common potential line common to the pixels arranged horizontally or vertically to each pixel as in the case of supply of the pixel potential. Thus, it is sufficient to control the operation on the basis of the low-speed clock having a frequency lower than that of the above (i).

According to the above aspect, the control unit controls the above operation of the power supply unit on the basis of the low-speed clock. Thus, it is possible to avoid controlling the operation, which is sufficiently controlled on a low-speed clock, unnecessarily on the basis of the high-speed clock to thereby drive the electrophoretic display device at lower power consumption.

In the aspect provided with the power supply unit, the power supply unit may be configured to vary the common potential to any one of a low potential level and a high potential level having a potential higher than the low potential level and then supply the common potential.

With the above configuration, it is possible to perform the following so-called "common oscillation driving" at lower power consumption. The power supply unit varies the common potential to a low potential (L) level and a high potential (H) level higher in potential than the low potential level in a binary manner against the pixel potential in each pixel in image display or image deletion. Particularly, in the image display, the power supply unit periodically varies the common potential to an L level and an H level and then supplies the common potential. Such driving may be called "common oscillation driving" in the following description.

When the common potential is thus varied as well, it is sufficient that the operation is controlled on the basis of the low-speed clock having a frequency lower than that of the above (i). Thus, as described above, supply of the common potential is controlled on the basis of the low-speed clock by the control unit, and is not controlled unnecessarily on the basis of the high-speed clock.

In the aspect of the first electrophoretic display device driving circuit according to the invention, a memory writing execution unit that executes writing of the image signal to the memory circuit may be further provided, wherein the control unit may control both the high-speed clock supply unit and the memory writing execution unit.

According to the above aspect, the control unit controls the high-speed clock supply unit to supply the high-speed clock to the memory writing execution unit, the operation of the above (i) is executed by the memory writing execution unit, and then in each pixel of the display unit, the image signal is written to the memory circuit.

Thus, by controlling the memory writing execution unit provided separately in the driving circuit according to the aspect of the invention, the control unit itself does not perform an operation that requires the high-speed clock and, therefore, it is sufficient that the control unit is driven on the low-speed clock. Thus, in this aspect, it is possible to drive the control unit on the basis of the low-speed clock, so it is possible to drive the electrophoretic display device at lower power consumption.

Another aspect of the invention provides a first electrophoretic display device. The electrophoretic display device includes: a display unit that includes a plurality of pixels, each of which includes an electrophoretic element, containing electrophoretic particles, that is provided between a pixel electrode and a common electrode that face each other, a pixel switching element, a memory circuit to which an image signal may be written through the pixel switching element, and a switch circuit that controls switching of the pixel electrode in accordance with an output based on the image signal in the memory circuit; a low-speed clock supply unit that supplies a low-speed clock; a high-speed clock supply unit that supplies a high-speed clock having a frequency higher than that of the low-speed clock; and a control unit that (i) controls writing of the image signal to the memory circuit on the basis of the high-speed clock, and that (ii) controls an operation including supply of a predetermined pixel potential to the pixel electrode through the switching control on the basis of the low-speed clock.

The first electrophoretic display device according to the aspect of the invention may be driven at a low power consumption as in the case of the above described first electrophoretic display device driving circuit according to the aspect of the invention.

Further another aspect of the invention provides a second electrophoretic display device driving circuit that drives an electrophoretic display device. The electrophoretic display device includes a display unit that includes a plurality of pixels, each of which includes an electrophoretic element, containing electrophoretic particles, that is provided between a pixel electrode and a common electrode that face each other; a pixel switching element; and a memory circuit to which an image signal may be written through the pixel switching element and which is able to supply a predetermined pixel potential to the pixel electrode in accordance with the written image signal. The electrophoretic display device driving circuit includes: a low-speed clock supply unit that supplies a low-speed clock; a high-speed clock supply unit that supplies a high-speed clock having a frequency higher than that of the low-speed clock; and a control unit that (i) controls writing of the image signal to the memory circuit on the basis of the high-speed clock, and that (ii) controls an operation including supply of a predetermined pixel potential to the pixel electrode on the basis of the low-speed clock.

In the electrophoretic display device driven by the second driving circuit according to the aspect of the invention, as almost similarly in the case of the electrophoretic display device driven by the first driving circuit according to the above described aspect of the invention, the electrophoretic particles are moved between the pixel electrode and the common electrode to thereby display an image on the display unit. In each pixel, prior to image display, (i) an image signal is supplied and written through the pixel switching element to the memory circuit, and other than the above (i), (ii) the predetermined pixel potential is supplied from the memory circuit to the pixel electrode in accordance with the written image signal to thereby apply a voltage between the pixel electrode and the common electrode. Note that in the operation of the above (ii), typically, the above described so-called "common oscillation driving is performed (that is, the common potential is supplied to the common electrode while being varied in a binary manner to a low potential (L) level and a high potential (H) level having a potential higher than that of the low potential level).

The second driving circuit according to the aspect of the invention includes the control unit that includes a controller that controls the operations of the above (i) and (ii) on the basis of the high-speed clock supplied from the high-speed clock supply unit and the low-speed clock supplied from the low-speed clock supply unit. The control unit writes image signals to the plurality of pixels on the basis of the high-speed clock in regard to the above (i) and supplies the predetermined pixel potential to the pixel electrodes on the basis of the low-speed clock in regard to the above (ii).

Thus, as almost similarly in the case of the first driving circuit according to the aspect of the invention, the control unit controls the operation of image display, or the like, of the above (ii) on the basis of the low-speed clock other than the operation of the above (i) that requires control based on the high-speed clock. Thus, in comparison with the case in which various control is regularly driven only on the basis of the high-speed clock, it is possible to reduce power consumption. Thus, it is possible to drive the electrophoretic display device at relatively low electric power and, therefore, it is possible to use a simple secondary battery, or the like.

In the aspect of the second electrophoretic display device driving circuit according to the invention, a power supply unit that supplies the pixel potential to the display unit and supplies a common potential to the common electrode in synchronization with the supply of the pixel potential may be provided, wherein the control unit may control supply of the pixel potential and the common potential by the power supply unit on the basis of the low-speed clock.

According to the above aspect, the power supply unit supplies the pixel potential to each of the plurality of pixels (more specifically, the memory circuit of each pixel) in the display unit and, in synchronization with this, supplies the common potential to the common electrode. The common potential is supplied through a common potential line common to the pixels arranged horizontally or vertically to each pixel as in the case of supply of the pixel potential. Thus, it is sufficient to control the operation on the basis of the low-speed clock having a frequency lower than that of the above (i).

According to the above aspect, the control unit controls the above operation of the power supply unit on the basis of the low-speed clock. Thus, it is possible to avoid controlling the operation, which is sufficiently controlled on a low-speed clock, unnecessarily on the basis of the high-speed clock to thereby drive the electrophoretic display device at lower power consumption.

In the aspect provided with the power supply unit, the power supply unit may be configured to vary the common potential to any one of a low potential level and a high potential level having a potential higher than that of the low potential level and then supply the common potential.

With the above configuration, it is possible to perform the so-called "common oscillation driving" at lower power consumption. For the common oscillation driving as well, it is sufficient to control the operation on the basis of the low-speed clock having a frequency lower than that of the above (i). According to the aspect, supply of the common potential is controlled on the basis of the low-speed clock by the control unit, and is not controlled unnecessarily on the basis of the high-speed clock.

In the aspect of the second electrophoretic display device driving circuit according to the invention, a memory writing execution unit that executes writing of the image signal to the memory circuit may be further provided, wherein the control unit may control both the high-speed clock supply unit and the memory writing execution unit.

According to the above aspect, the control unit controls the high-speed clock supply unit to supply the high-speed clock to the memory writing execution unit, the operation of the above (i) is executed by the memory writing execution unit, and then in each pixel of the display unit, the image signal is written to the memory circuit.

Thus, by controlling the memory writing execution unit provided separately in the driving circuit according to the aspect of the invention, the control unit itself does not perform an operation that requires the high-speed clock and, therefore, it is sufficient that the control unit is driven on the low-speed clock. Thus, in this aspect, it is possible to drive the control unit on the basis of the low-speed clock, so it is possible to drive the electrophoretic display device at lower power consumption.

Yet another aspect of the invention provides a second electrophoretic display device. The second electrophoretic display device includes the second electrophoretic display device driving circuit according to the aspect of the invention (including its various aspects).

According to the second electrophoretic display device of the aspect of the invention, because the above described second electrophoretic display device driving circuit according to the aspect of the invention is provided, it is possible to be driven at a low power consumption.

Another aspect of the invention provides an electronic apparatus. The electronic apparatus includes the above described first or second electrophoretic display device according to the aspects of the invention.

Because the electronic apparatus of the aspect of the invention includes the above described first or second electrophoretic display device according to the aspects of the invention, various electronic apparatuses, such as a watch, an electronic paper, an electronic notebook, a cellular phone, or a portable audio device, that may be driven at low power consumption may be implemented.

The function and other advantageous effects of the aspects of the invention will become apparent from embodiments described below.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings.

First Embodiment

First, the overall configuration of an electrophoretic display panel in an electrophoretic display device according to the present embodiment will be described with reference to FIG. 1 and FIG. 2.

Figure 1:
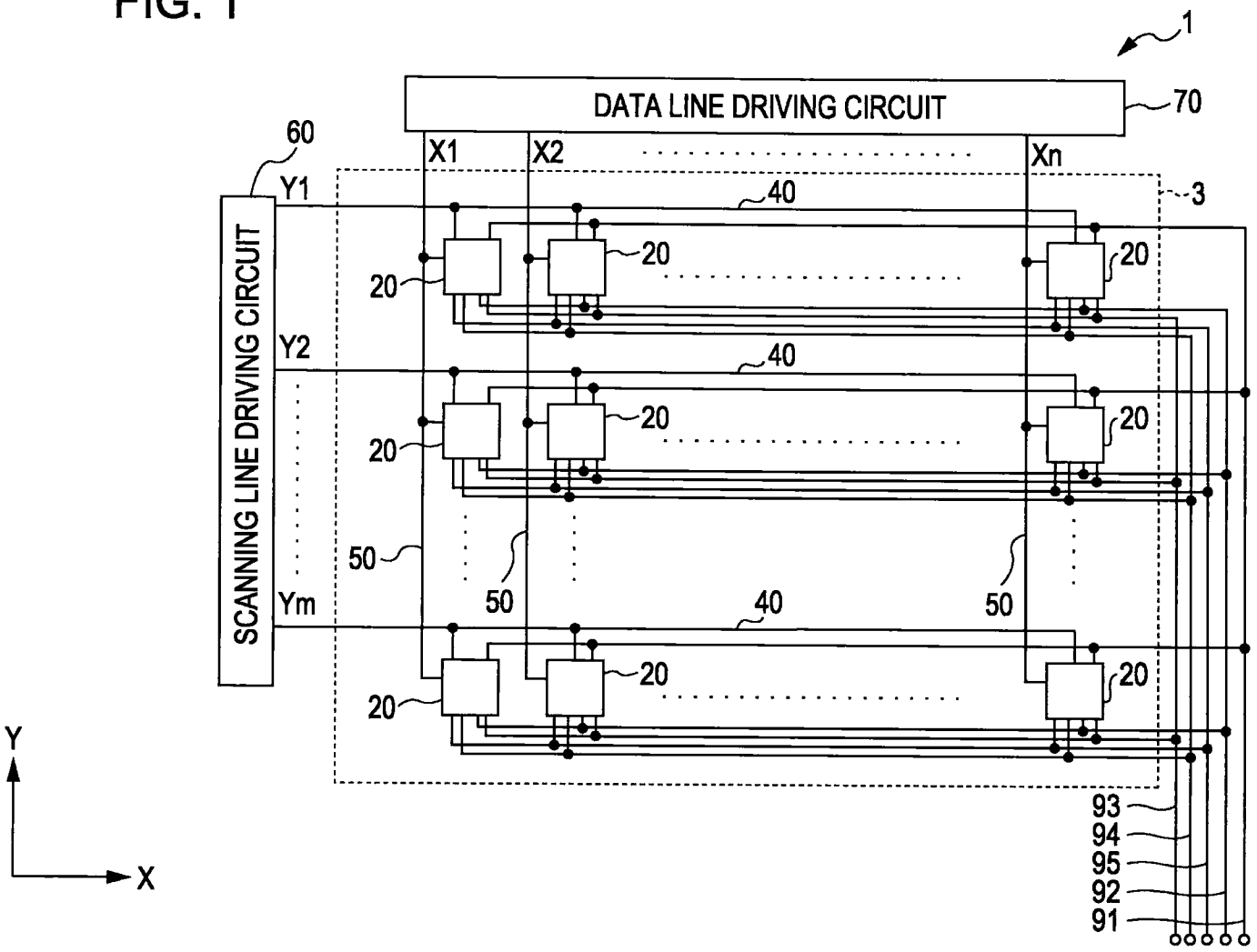
FIG. 1 is a block diagram that shows the overall configuration of an electrophoretic display panel according to a first embodiment.

FIG. 1 is a block diagram that shows the overall configuration of the electrophoretic display panel according to the present embodiment.

As shown in FIG. 1, the electrophoretic display panel 1 according to the present embodiment includes a display unit 3, a scanning line driving circuit 60 and a data line driving circuit 70 as principal components.

In the display unit 3, pixels 20 are arranged in a matrix (in a two-dimensional plane) of m rows and n columns. In addition, m scanning lines 40 (that is, scanning lines Y1, Y2, . . . , Ym) and n data lines 50 (that is, data lines X1, X2, . . . , Xn) are provided in the display unit 3 so as to intersect with one another. Specifically, the m scanning lines 40 extend horizontally (that is, X direction), and the n data lines 50 extend vertically (that is, Y direction). The pixels 20 are arranged at positions corresponding to intersections of the m scanning lines 40 and the n data lines 50.

The scanning line driving circuit 60 sequentially supplies a scanning signal to each of the scanning lines Y1, Y2, . . . , Ym in a pulse-like manner on the basis of a timing signal. The data line driving circuit 70 supplies image signals to the data lines X1, X2, . . . , Xn on the basis of the timing signal. Each image signal holds a binary level, that is, a high-potential level (hereinafter, referred to as "high level", for example, 5 V) or a low-potential level (hereinafter, referred to as "low level", for example, 0 V).

Here, each pixel 20 is electrically connected to a high-potential power supply line 91, a low-potential power supply line 92, a common potential line 93, a first control line 94 and a second control line 95. The high-potential power supply line 91, the low-potential power supply line 92, the common potential line 93, the first control line 94 and the second control line 95 each are typically wired commonly to the pixels 20 that belong to a pixel column in units of the pixel columns formed of the pixels 20 arranged horizontally (X direction) as shown in FIG. 1.

Figure 2:
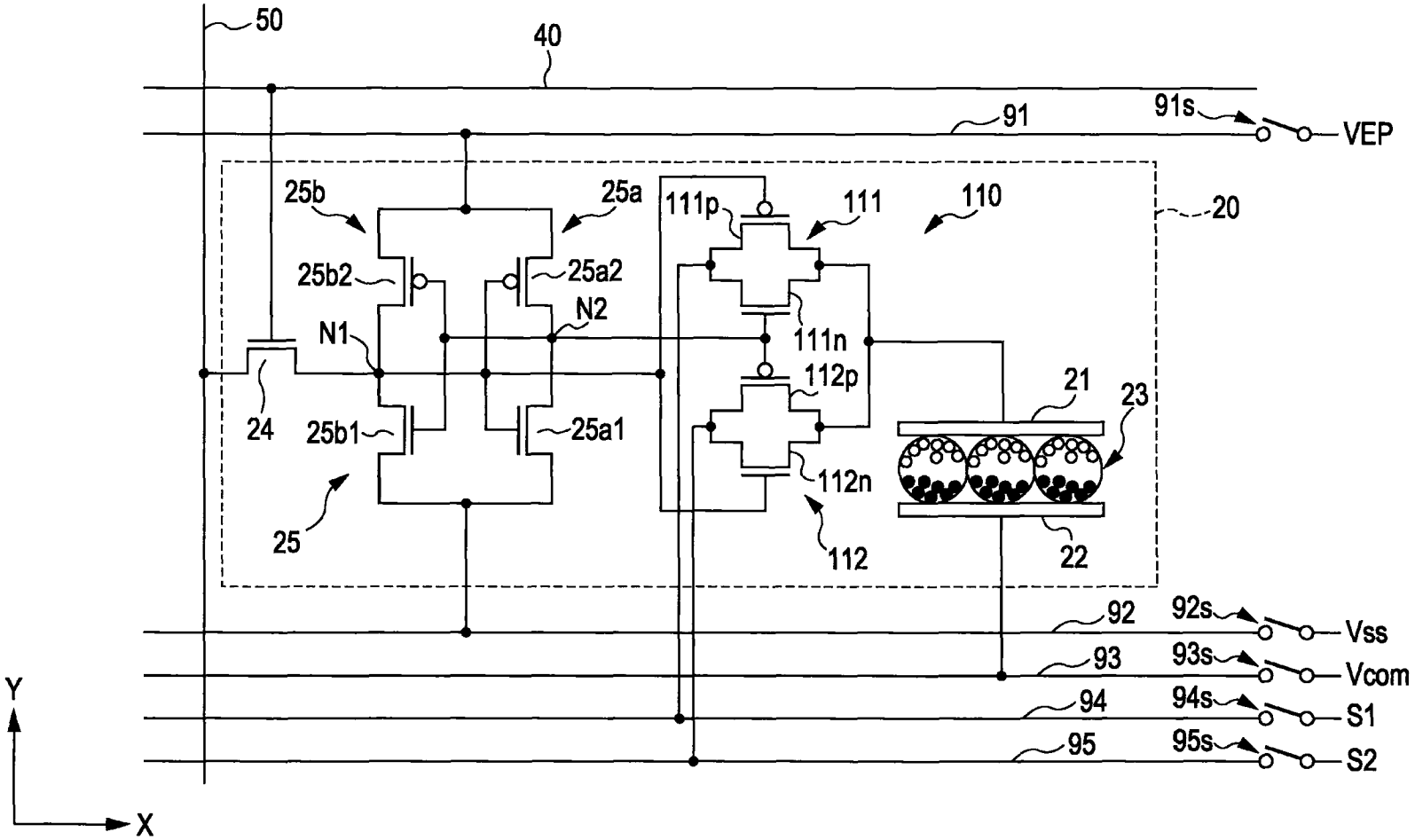
FIG. 2 is an equivalent circuit diagram that shows the electrical configuration of a pixel according to the first embodiment.

FIG. 2 is an equivalent circuit diagram that shows the electrical configuration of a pixel.

As shown in FIG. 2, each pixel 20 includes a pixel switching transistor 24, which is an example of "pixel switching element" according to the aspects of the invention, a memory circuit 25, a switch circuit 110, a pixel electrode 21, a common electrode 22, and an electrophoretic element 23.

The pixel switching transistor 24 is formed of an N-type transistor as an example. The gate of the pixel switching transistor 24 is electrically connected to the scanning line 40, the source thereof is electrically connected to the data line 50, and the drain thereof is electrically connected to an input terminal N1 of the memory circuit 25. The pixel switching transistor 24 outputs the image signal, supplied from the data line driving circuit 70 (see FIG. 1) through the data line 50, to the input terminal N1 of the memory circuit 25 at the timing based on the scanning signal supplied in a pulse-like manner from the scanning line driving circuit 60 (see FIG. 1) through the scanning line 40.

The memory circuit 25, for example, includes inverter circuits 25*a* and 25*b*, and is formed as an SRAM (Static Random Access Memory)

The inverter circuits 25*a* and 25*b* form a loop structure such that the input terminals are connected to the output terminals of the other one. That is, the input terminal of the inverter circuit 25*a* is electrically connected to the output terminal of the inverter circuit 25*b*, and the input terminal of the inverter circuit 25*b* is electrically connected to the output terminal of the inverter circuit 25*a*. The input terminal of the inverter circuit 25*a* is formed as the input terminal N1 of the memory circuit 25. The output terminal of the inverter circuit 25*a* is formed as the output terminal N2 of the memory circuit 25.

The inverter circuit 25*a* has an N-type transistor 25*a*1 and a P-type transistor 25*a*2. The gates of the N-type transistor 25*a*1 and P-type transistor 25*a*2 are electrically connected to the input terminal N1 of the memory circuit 25. The source of the N-type transistor 25*a*1 is electrically connected to the low-potential power supply line 92 to which a low-potential power supply potential Vss is supplied. The source of the P-type transistor 25*a*2 is electrically connected to the high-potential power supply line 91 to which a high-potential power supply potential VEP is supplied. The drains of the N-type transistor 25*a*1 and P-type transistor 25*a*2 are electrically connected to the output terminal N2 of the memory circuit 25.

The inverter circuit 25*b* has an N-type transistor 25*b*1 and a P-type transistor 25*b*2. The gates of the N-type transistor 25*b*1 and P-type transistor 25*b*2 are electrically connected to the output terminal N2 of the memory circuit 25. The source of the N-type transistor 25*b*1 is electrically connected to the low-potential power supply line 92 to which the low-potential power supply potential Vss is supplied. The source of the P-type transistor 25*b*2 is electrically connected to the high-potential power supply line 91 to which the high-potential power supply potential VEP is supplied. The drains of the N-type transistor 25*b*1 and P-type transistor 25*b*2 are electrically connected to the input terminal N1 of the memory circuit 25.

When a high-level image signal is input to the input terminal N1 of the memory circuit 25, the memory circuit 25 outputs the low-potential power supply potential Vss from the output terminal N2. When a low-level image signal is input to the input terminal N1 of the memory circuit 25, the memory circuit 25 outputs the high-potential power supply potential VEP from the output terminal N2. That is, the memory circuit 25 outputs the low-potential power supply potential Vss or the high-potential power supply potential VEP on the basis of whether the input image signal is at a high level or at a low level. In other words, the memory circuit 25 is able to store the input image signal as the low-potential power supply potential Vss or the high-potential power supply potential VEP.

The switch circuit 110 includes a first transmission gate 111 and a second transmission gate 112.

The first transmission gate 111 includes a P-type transistor 111*p* and an N-type transistor 111*n*. The sources of the P-type transistor 111*p* and N-type transistor 111*n* are electrically connected to the first control line 94. The drains of the P-type transistor 111*p* and N-type transistor 111*n* are electrically connected to the pixel electrode 21. The gate of the P-type transistor 111*p* is electrically connected to the input terminal N1 of the memory circuit 25. The gate of the N-type transistor 111*n* is electrically connected to the output terminal N2 of the memory circuit 25.

The second transmission gate 112 has a P-type transistor 112*p* and an N-type transistor 112*n*. The sources of the P-type transistor 112*p* and N-type transistor 112*n* are electrically connected to the second control line 95. The drains of the P-type transistor 112*p* and N-type transistor 112*n* are electrically connected to the pixel electrode 21. The gate of the P-type transistor 112*p* is electrically connected to the output terminal N2 of the memory circuit 25. The gate of the N-type transistor 112*n* is electrically connected to the input terminal N1 of the memory circuit 25.

The switch circuit 110 selects any one of the first control line 94 and the second control line 95 on the basis of the image signal input to the memory circuit 25, and electrically connects the one of the control lines to the pixel electrode 21.

Specifically, when a high-level image signal is input to the input terminal N1 of the memory circuit 25, the low-potential power supply potential Vss is output from the memory circuit 25 to the gates of the N-type transistor 111*n* and P-type transistor 112*p*, and the high-potential power supply potential VEP is output from the memory circuit 25 to the gates of the P-type transistor 111*p* and N-type transistor 112*n*. Thus, only the P-type transistor 112*p* and the N-type transistor 112*n* that constitute the second transmission gate 112 turn on, and the P-type transistor 111*p* and the N-type transistor 111*n* that constitute the first transmission gate 111 turn off. On the other hand, when a low-level image signal is input to the input terminal N1 of the memory circuit 25, the high-potential power supply potential VEP is output from the memory circuit 25 to the gates of the N-type transistor 111*n* and P-type transistor 112*p*, and the low-potential power supply potential Vss is output from the memory circuit 25 to the gates of the P-type transistor 111*p* and N-type transistor 112*n*. Thus, only the P-type transistor 111*p* and the N-type transistor 111*n* that constitute the first transmission gate 111 turn on, and the P-type transistor 112*p* and the N-type transistor 112*n* that constitute the second transmission gate 112 turn off. That is, when a high-level image signal is input to the input terminal N1 of the memory circuit 25, only the second transmission gate 112 turns on, while, when a low-level image signal is input to the input terminal N1 of the memory circuit 25, only the first transmission gate 111 turns on.

The pixel electrode 21 of each of the plurality of pixels 20 is electrically connected to one of the first control line 94 and the second control line 95 selected by the switch circuit 110 on the basis of the image signal. Then, the pixel electrode 21 of each of the plurality of pixels 20 is supplied with a first potential S1 or a second potential S2 or is caused to enter a high impedance state on the basis of on/off state of the switch 94*s* or 95*s*. Note that the first potential S1 or the second potential S2 is an example of "pixel potential" according to the aspects of the invention.

More specifically, in the pixel 20 to which a low-level image signal is supplied, only the first transmission gate 111 turns on, the pixel electrode 21 of the pixel 20 is electrically connected to the first control line 94, and then the first potential S1 is supplied from a power supply circuit 210 or is caused to enter a high impedance state on the basis of on/off state of the switch 94*s*. On the other hand, in the pixel 20 to which a high-level image signal is supplied, only the second transmission gate 112 turns on, the pixel electrode 21 of the pixel 20 is electrically connected to the second control line 95, and then the second potential S2 is supplied from the power supply circuit 210 or is caused to enter a high impedance state on the basis of on/off state of the switch 95*s*.

Each pixel electrode 21 is arranged so as to face the common electrode 22 through the electrophoretic element 23. The common electrode 22 is electrically connected to the common potential line 93 to which a common potential Vcom is supplied.

The electrophoretic element 23 is formed of a plurality of microcapsules, each of which contains electrophoretic particles.

Next, a specific configuration of the display unit of the electrophoretic display panel according to the present embodiment will be described with reference to FIG. 3 and FIG. 4.

Figure 3:
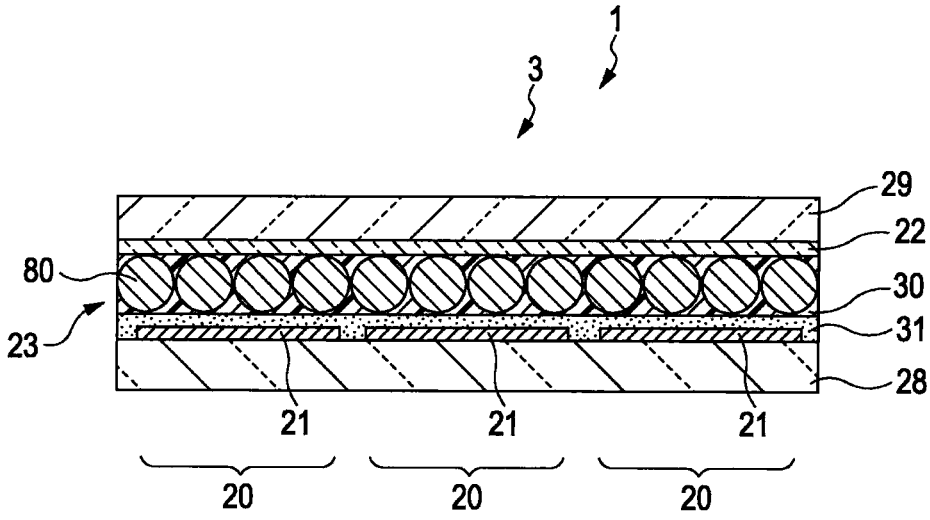
FIG. 3 is a partially cross-sectional view of a display unit of the electrophoretic display panel according to the first embodiment.

FIG. 3 is a partially cross-sectional view of the display unit of the electrophoretic display panel according to the present embodiment.

As shown in FIG. 3, the display unit 3 is formed so that the electrophoretic elements 23 are held between an element substrate 28 and an opposite substrate 29. Note that in the present embodiment, the description will be made on the assumption that an image is displayed on the side of the opposite substrate 29.

The element substrate 28 is a substrate made of, for example, glass, plastic, or the like. A laminated structure (not shown) is formed on the element substrate 28. The laminated structure is formed of the pixel switching transistors 24, the memory circuits 25, the switch circuits 110, the scanning lines 40, the data lines 50, the high-potential power supply lines 91, the low-potential power supply lines 92, the common potential lines 93, the first control lines 94, the second control lines 95, and the like, which are described with reference to FIG. 2. The plurality of pixel electrodes 21 are provided in a matrix at the upper layer side of the laminated structure.

The opposite substrate 29 is a transparent substrate made of, for example, glass, plastic, or the like. The common electrode 22 is formed on a surface of the opposite substrate 29, facing the element substrate 28, in a solid manner so as to face the plurality of pixel electrodes 9*a*. The common electrode 22 is, for example, made of a transparent conductive material, such as magnesium silver (MgAg), indium tin oxide (ITO), or indium zinc oxide (IZO).

Each electrophoretic element 23 is formed of a plurality of microcapsules 80, each of which contains electrophoretic particles, and is fixed between the element substrate 28 and the opposite substrate 29 by an adhesive layer 31 and a binder 30 made of, for example, resin, or the like. Note that the electrophoretic display panel 1 according to the present embodiment is formed in a manufacturing process such that an electrophoretic sheet formed by fixing the electrophoretic elements 23 on the side of the opposite substrate 29 by the binder 30 beforehand is adhered onto the side of the element substrate 28, which is manufactured separately and on which the pixel electrodes 21, and the like, are formed by the adhesive layer 31.

The microcapsules 80 are held between the pixel electrode 21 and the common electrode 22, and one or plurality of the microcapsules 80 are arranged in one pixel 20 (in other words, for one pixel electrode 21).

Figure 4:
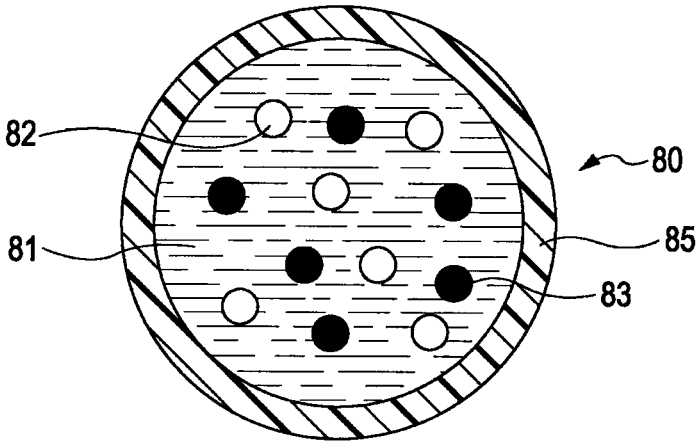
FIG. 4 is a schematic view that shows the configuration of a microcapsule.

FIG. 4 is a schematic view that shows the configuration of the microcapsule. Note that FIG. 4 schematically shows the cross-sectional view of the microcapsule.

As shown in FIG. 4, the microcapsule 80 is formed so that a dispersion medium 81, a plurality of white particles 82 and a plurality of black particles 83 are enclosed inside a film 85. The microcapsule 80 is, for example, formed in a spherical shape having a diameter of about 50 um. Note that the white particles 82 and the black particles 83 are an example of "electrophoretic particle" according to the aspects of the invention.

The film 85 serves as an outer shell of the microcapsule 80, and is made of a translucent polymer resin, for example, an acrylic resin such as polymethylmethacrylate or polyethylmethacrylate, urea resin, and gum arabic.

The dispersion medium 81 is a medium that disperses the white particles 82 and the black particles 83 in the microcapsule 80 (in other words, in the film 85). The dispersion medium 81 may include, for example, water, alcohol medium, such as methanol, ethanol, isopropanol, butanol, octanol, and methyl cellosolve, various esters, such as ethyl acetate, and butyl acetate, ketones, such as acetone, methyl ethyl ketone, and methyl isobutyl ketone, aliphatic hydrocarbon, such as pentane, hexane, and octane, alicyclic hydrocarbon, such as cyclohexane, and methylcyclohexane, aromatic hydrocarbon, such as benzenes, having long-chain alkyl group, such as benzene, toluene, xylene, hexylbenzene, hebutylbenzene, octylbenzene, nonylbenzene, decylbenzene, undecylbenzene, dodecylbenzene, tridecylbenzene, and tetradecylbenzene, halogenated hydrocarbon, such as methylene chloride, chloroform, carbon tetrachloride, and 1,2-dichloroethane, carboxylate, and other various oils, either alone or in combination. The dispersion medium 81 may be mixed with a surface-active agent.

The white particles 82 are, for example, particles (polymer or colloid) formed of white pigment, such as titanium dioxide, zinc white (zinc oxide), and antimony trioxide, and are, for example, negatively charged.

The black particles 83 are, for example, particles (polymer or colloid) formed of black pigment, such as aniline black, and carbon black, and are, for example, positively charged.

For this reason, the white particles 82 and the black particles 83 are able to move in the dispersion medium 81 owing to an electric field that is generated by a potential difference between the pixel electrodes 21 and the common electrode 22.

These pigments may include additives such as electrolyte, surface active agent, metallic soap, resin, rubber, oil, varnish, charge control agent formed of particles such as compound, and dispersing agent, lubricant, stabilizing agent such as titanium-based coupling agent, aluminum-based coupling agent, and silane-based coupling agent, where necessary.

In FIG. 3 and FIG. 4, when a voltage is applied between the pixel electrode 21 and the common electrode 22 so that the potential of the common electrode 22 is relatively high, the positively-charged black particles 83 are attracted on the basis of Coulomb force toward the pixel electrode 21 in the microcapsule 80, while the negatively-charged white particles 82 are attracted on the basis of Coulomb force toward the common electrode 22 in the microcapsule 80. As a result, the white particles 82 gather on the display surface side (common electrode 22 side) in the microcapsule 80, and the color (white color) of the white particles 82 is displayed on the display surface of the display unit 3. Conversely, when a voltage is applied between the pixel electrode 21 and the common electrode 22 so that the potential of the pixel electrode 21 is relatively high, the negatively-charged white particles 82 are attracted on the basis of Coulomb force toward the pixel electrode 21, while the positively-charged black particles 83 are attracted on the basis of Coulomb force toward the pixel electrode 21. As a result, the black particles 83 gather on the display surface side of the microcapsule 80, and the color (black color) of the black particles 83 is displayed on the display surface of the display unit 3.

Note that it is possible to display gray color, such as light gray, gray, or dark gray, which is a halftone between white color and black color by means of a dispersion state of the white particles 82 and the black particles 83 between the pixel electrode 21 and the common electrode 22. In addition, by replacing the pigments used for the white particles 82 and the black particles 83 with, for example, pigments, such as red color, green color, blue color, and the like, it is possible to display red color, green color, blue color, and the like.

Next, a driving circuit for driving the above described electrophoretic display panel 1 will be described with reference to FIG. 5. Note that the driving circuit described below may be formed together with the scanning line driving circuit 60, the data line driving circuit 70, and the like, in the electrophoretic display panel 1, or may be, for example, provided outside the panel as an external circuit and then mounted on the electrophoretic display panel 1.

Figure 5:
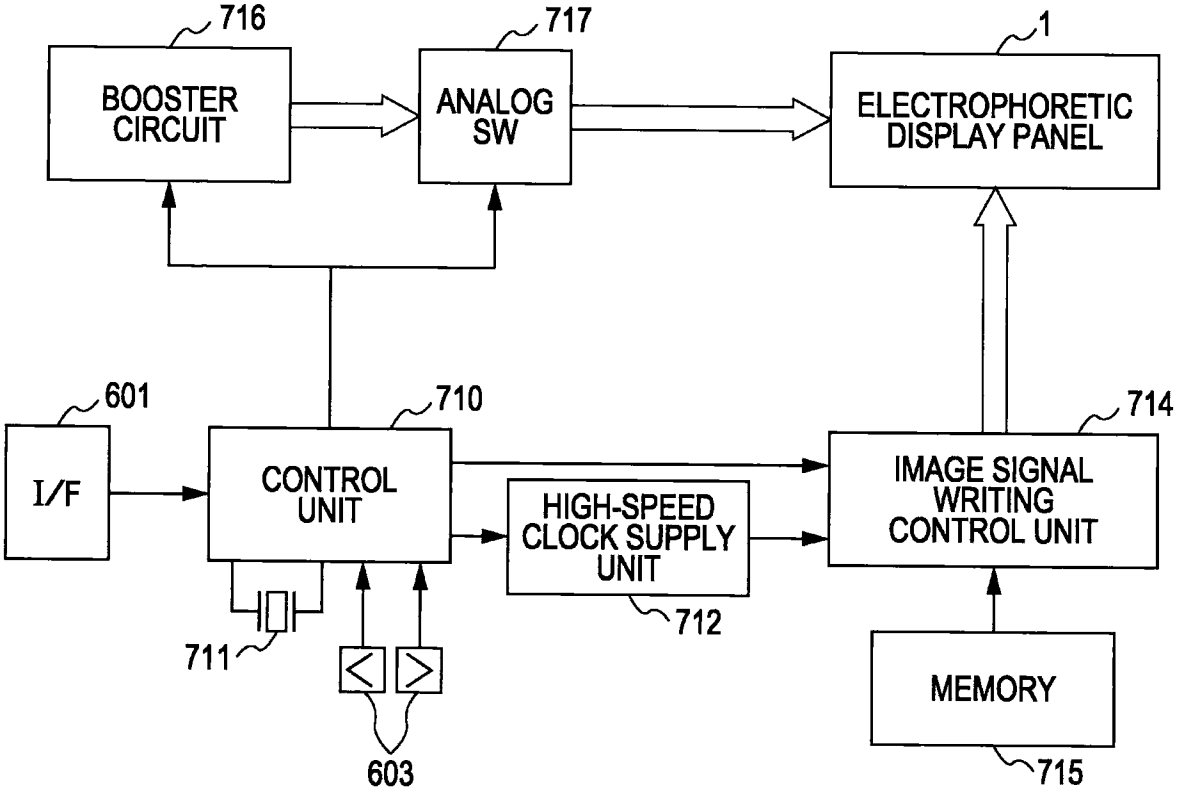
FIG. 5 is a block diagram that schematically shows the configuration of a driving circuit that drives the electrophoretic display panel according to the first embodiment.

FIG. 5 is a block diagram that schematically shows the configuration of the driving circuit that drives the electrophoretic display panel according to the present embodiment. The driving circuit includes a control unit 710 that includes a controller, a low-speed clock supply unit 711, a high-speed clock supply unit 712, an image signal writing control unit 714, a memory 715, a booster circuit 716 and an analog switch 717, as its principal components. The electrophoretic display device according to the present embodiment includes the driving circuit and the electrophoretic display panel 1 as its principal configuration.

The control unit 710 controls driving of the electrophoretic display panel 1, and controls the high-speed clock supply unit 712, the image signal writing control unit 714, the memory 715, and operations of the booster circuit 716 and the analog switch 717. Alternatively, the control unit 710 recognizes an instruction through an external interface (I/F) 601 via, for example, USB outside the electrophoretic display device, key input to next page or previous page buttons 603 as a UI (User Interface), or the like, and then starts up the driving circuit and/or the electrophoretic display panel 1, manages the temperature of the electrophoretic display device, or the like.

The low-speed clock supply unit 711 and the high-speed clock supply unit 712 are formed to include a quartz oscillator, and the like, and is able to generate and supply a clock of a predetermined frequency. The low-speed clock supply unit 711 supplies, for example, a low-speed 31 kHz clock for driving the control unit 710, and the high-speed clock supply unit 712 supplies a high-speed clock having a frequency higher than that of the low-speed clock (for example, 2.4 MHz). A specific low-speed clock oscillator may employ an oscillator circuit that uses a fork quartz oscillator, or a CR oscillator circuit. In addition, a specific high-speed clock oscillator may be suitably a CR oscillator circuit, an oscillator circuit that uses a ring oscillator or a ceramic oscillator, an oscillator circuit that uses an AT oscillator (quartz), or the like. Particularly, because highly accurate oscillation is not required for driving the electrophoretic display device, the CR oscillator circuit is used for both the low-speed clock and the high-speed clock to thereby make it possible to form each clock supply unit with a low-cost and simple structure.

The booster circuit 716 is able to supply various power source for driving the electrophoretic display panel 1 through the analog switch 717. Note that the booster circuit 716 and the analog switch 717 constitute an example of "power supply unit" according to the aspects of the invention.

As shown in FIG. 1 or FIG. 2, the booster circuit 716 supplies the high-potential power supply line 91 with the high-potential power supply potential VEP, supplies the low-potential power supply line 92 with the low-potential power supply potential Vss, supplies the common potential line 93 with the common potential Vcom, supplies the first control line 94 with the first potential S1, and supplies the second control line 95 with the second potential S2. In addition, the booster circuit 716 supplies power source for driving the scanning line driving circuit 60, the data line driving circuit 70, and the like.

The analog switch 71 includes five types of switches 91*s*, 92*s*, 93*s*, 94*s* and 95*s* shown in FIG. 2. The high-potential power supply potential VEP is supplied through the switch 91*s* to the high-potential power supply line 91. Similarly, the low-potential power supply potential Vss, the common potential Vcom, the first potential S1 and the second potential S2 are supplied respectively through the switches 92*s*, 93*s*, 94*s* and 95*s* to the low-potential power supply line 92, the common potential line 93, the first control line 94 and the second control line 95. Each of the five types of switches 91*s*, 92*s*, 93*s*, 94*s* and 95*s* may be switched between an on state and an off state by the control unit 710. When the switch 91*s* turns on, the high-potential power supply line 91 is electrically connected to the booster circuit 716. When the switch 91s turns off, the high-potential power supply line 91 is electrically disconnected to enter a high impedance state. Similarly, when one of the switches 92*s*, 93*s*, 94*s* and 95*s* turns on, a corresponding one of the low-potential power supply line 92, the common potential line 93, the first control line 94 and the second control line 95 is connected to the booster circuit 716. When one of the switches turns off, a corresponding one of the low-potential power supply line 92, the common potential line 93, the first control line 94 and the second control line 95 enters a high impedance state.

In FIG. 5, the image signal writing control unit 714 and the memory 715 constitute an example of "memory writing execution unit" according to the aspects of the invention. The image signal writing control unit 714, as described above, executes a writing operation of the image signal, which causes the memory circuit 25 of the pixel 20 shown in FIG. 2 to store the image signal, in accordance with a sequence read from the memory 715 on the basis of the high-speed clock supplied from the high-speed clock supply unit 712.

Subsequently, the display operation in the electrophoretic display device will be described with reference to FIG. 6.

Figure 6:
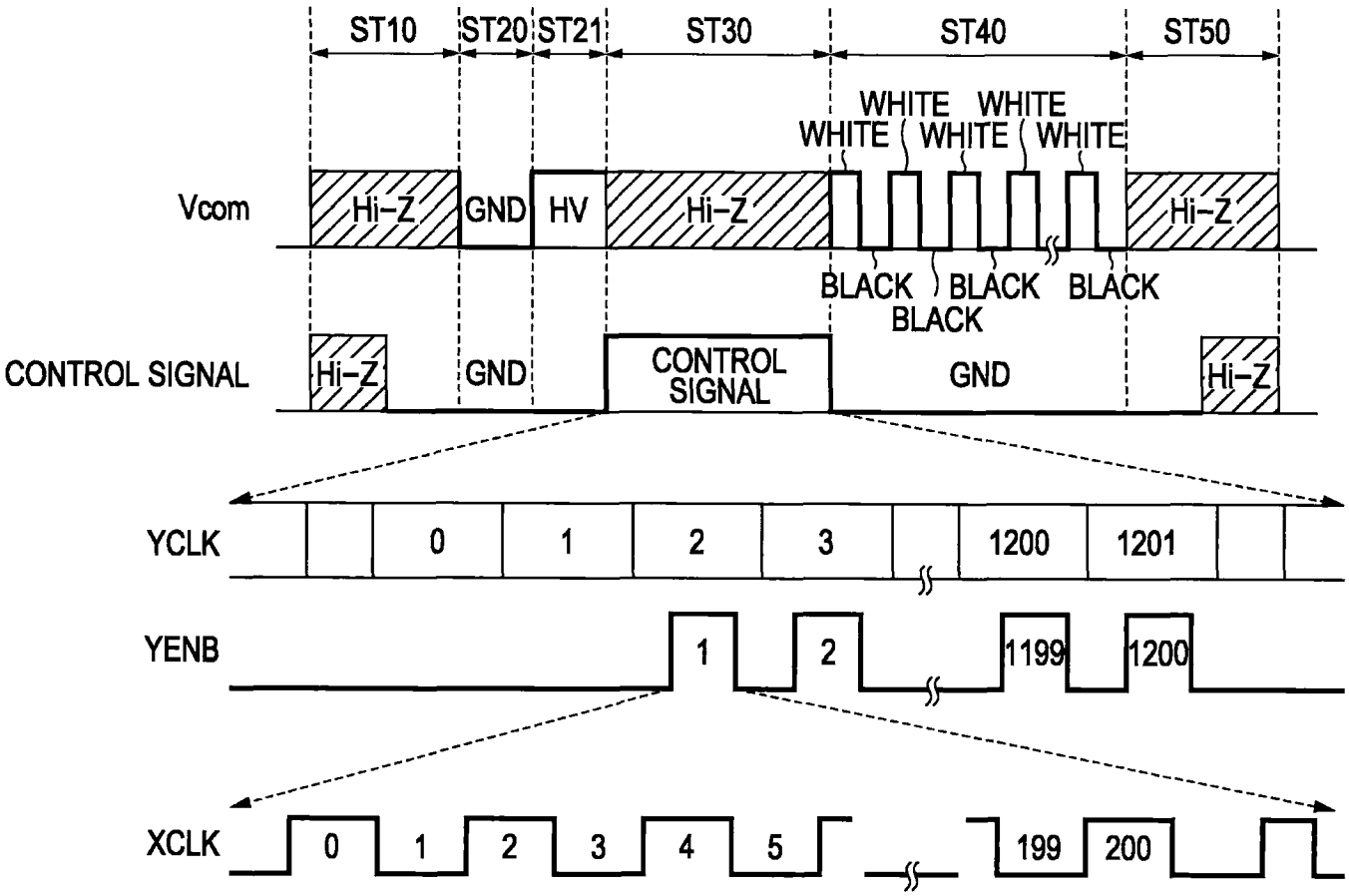
FIG. 6 is a timing chart that illustrates a display operation in the electrophoretic display device according to the first embodiment.

FIG. 6 is a timing chart that illustrates the display operation in the electrophoretic display device.

As shown in FIG. 6, in the present embodiment, after a power supply off period ST10 before starting the sequence according to the display operation, during deletion periods ST20 and ST21 a previous image is deleted. After that, in each pixel 20 shown in FIG. 1 or FIG. 2, after an image signal writing period ST30 during which an image signal is written, during a display period ST40 the pixel electrode 21 is supplied with the first potential S1 or the second potential S2 to display an image on the display unit 3. Then, a series of operations ends and enters again to the power supply off period ST50.

FIG. 6 shows the common potential Vcom, a control signal from the control unit 710 shown in FIG. 5 to the image signal writing control unit 714, and various timing signals supplied from the image signal writing control unit 714 on the basis of the control signal to the data line driving circuit 70 and the scanning line driving circuit 60 shown in FIG. 1.

In FIG. 5, in the power supply off period ST10 before starting the sequence, the control unit 710 is in a standby mode in which an instruction through, for example, the external interface (I/F) 601, key input to the next page or previous page buttons 603, or the like, is waited. When the control unit 710 recognizes the instruction, the control unit 710 operates on the basis of the low-speed clock from the low-speed clock supply unit 711. In the standby mode, supply of various power from the booster circuit 716 is not performed, and in the pixel 20 shown in FIG. 20, the switches 91*s*, 92*s*, 93*s*, 94*s* and 95*s* are turned off. Thus, the high-potential power supply line 91, the low-potential power supply line 92, the common potential line 93, the first control line 94 and the second control line 95 all are in a high impedance state. Hence, in FIG. 6, the common potential Vcom is also in a high impedance state (Hi-Z).

After that, the electrophoretic display device is started up by the control unit 710, and the deletion periods ST20 and ST21 during which a previous image is deleted are initiated in order to switch display on the display unit 3. In the deletion periods ST20 and ST21, in each pixel 20 of the display unit 2 shown in FIG. 1, the memory circuit 25 shown in FIG. 2 holds a low-level or high-level image signal that is input when the previous image is displayed. Thus, in each pixel 20, on the basis of an output (that is, the high-potential power supply potential VEP and the low-potential power supply potential Vss) from the memory circuit 25, one of the first transmission gate 111 and the second transmission gate 112 of the switch circuit 110 is turned on.

Specifically, in each of the pixels 20 to which a low-level image signal is input, only the first transmission gate 111 is turned on, and the pixel electrode 21 is electrically connected to the first control line 94. In addition, in each of the pixels 20 to which a high-level image signal is input, only the second transmission gate 112 is turned on, and the pixel electrode 21 is electrically connected to the second control line 95.

At this time, in FIG. 5, the control unit 710 controls operations of the booster circuit 716 and the analog switch 717 on the basis of the low-speed clock. The booster circuit 710 supplies the high-level (for example, 15 V) high-potential power supply potential VEP and the low-potential power supply potential Vss (for example, 0 V) for driving the memory circuit 25, while the booster circuit 710 supplies the first potential S1 for driving the first control line 94 and the second potential S2 for driving the second control line 95 at one of the low level (for example, 0 V) and the high level (for example, 15 V). That is, in the deletion periods ST20 and ST21, the first potential S1 and the second potential S2 are supplied at the same potential.

In addition, as shown in FIG. 6, the booster circuit 710 varies the common potential Vcom to any one of the low level (for example, 0 V) and the high level (for example, 15 V ) on the basis of the first potential S1 and the second potential S2, and then supplies the common potential Vcom.

The thus supplied high-potential power supply potential VEP, low-potential power supply potential Vss, first potential S1, second potential S2 and common potential Vcom are supplied by the control unit 710 through the turned-on switches 91*s*, 92*s*, 93*s*, 94*s* and 95*s* to various lines 91, 92, 93, 94 and 95 shown in FIG. 2.

Thus, in each pixel 20 of the display unit 3, the pixel electrode 21 is supplied through the first control line 94 or the second control line 95 with the first potential S1 or the second potential S2, and the common electrode 22 is supplied through the common potential line 93 with the common potential Vcom. Thus, when the pixel electrode 21 is supplied with the high-level first potential S1 or second potential S2, and the common electrode 22 is supplied with the low-level common potential Vcom, solid black color is displayed on the display unit 3 as described above. In contrast, when the pixel electrode 21 is supplied with the low-level first potential S1 or second potential S2, and the common electrode 22 is supplied with the high-level common potential Vcom, solid white color is displayed on the display unit 3 as described above.

Note that in the deletion periods ST20 and ST21, the booster circuit 710 may supply the first control line 94 and the second control line 95 through the switches 94*s* and 95*s* with the first potential S1 and the second potential S2 having different potentials so as to be able to invert the grayscale of display in each pixel 20.

In addition, in FIG. 6, in a period from the middle of the power supply off period ST10 before the sequence to the deletion periods ST20 and ST21, the control signal from the control unit 710 is maintained at a low level (for example, 0 V, which is a ground potential (GND)). After that, when the image signal writing period ST30 is initiated, as shown in FIG. 6, the control signal from the control unit 710 attains a high level. Thus, the image signal writing control unit 714 is started up, and the high-speed clock is supplied from the high-speed clock supply unit 712 to the image signal writing control unit 714. The image signal writing control unit 714 reads a sequence according to the image signal writing operation from the memory 715, and executes the sequence on the basis of the high-speed clock.

In FIG. 6, the image signal writing control unit 714 generates various timing signals, on the basis of the supplied high-speed clock, that include a Y-side clock signal YCLK (for example, 3 kHz) for driving the scanning line driving circuit 60 shown in FIG. 1 and an X-side clock signal XCLK (for example, 600 kHz) for driving the data line driving circuit 70, and then supplies the timing signals to the electrophoretic display panel 1.

In FIG. 1, the scanning line driving circuit 60 sequentially supplies scanning signals to the scanning lines Y1, Y2, . . . , Ym on the basis of the Y-side clock signal YCLK. The pulse of the scanning signal is defined by an enable signal YENB, shown in FIG. 6, which is included in the timing signal supplied from the image signal writing control unit 714. Then, in a period during which one of the scanning lines Y1, Y2, . . . , Ym is selected on the basis of one enable signal YENB, the data line driving circuit 70 supplies image signals to the data lines X1, X2, . . . , Xn on the basis of the X-side clock signal XCLK.

In FIG. 2, in each pixel 20, in accordance with the scanning signal, an image signal is input from the pixel switching transistor 24 to the input terminal N1 of the memory circuit 25.

In FIG. 5, the booster circuit 716 supplies the high-level (for example, 5 V) high-potential power supply potential VEP and the low-level low-potential power supply potential Vss (for example, 0 V). In FIG. 2, the high-potential power supply potential VEP and the low-potential power supply potential Vss are respectively supplied through the turned-on switches 91*s* and 92*s* to the high-potential power supply line 91 and the low-potential power supply line 92. On the other hand, in the image signal writing period ST30, the booster circuit 716 does not supply the common potential Vcom, the first potential S1 or the second potential S2 and, therefore, the switches 93*s*, 94*s* and 95*s* are turned off. Thus, the common potential Vcom shown in FIG. 6 is in a high impedance state (Hi-Z), and the common potential line 93, the first control line 94 and the second control line 95 shown in FIG. 2 are in a high impedance state.

Subsequently, the display period ST40 is initiated. In FIG. 5, the control signal from the control unit 710 attains a low level as shown in FIG. 6, supply of the high-speed clock from the high-speed clock supply unit 712 is interrupted, and the operation of the image signal writing control unit 714 is also interrupted. Driving of the booster circuit 716 and the analog switch 717 is controlled by the control unit 710 on the basis of the low-speed clock.

The booster circuit 716 supplies the high-level high-potential power supply potential VEP (for example, 15 V) and the low-level low-potential power supply potential Vss (for example, 0 V), supplies the first potential S1 as a high level (for example, 15 V ), and supplies the second potential S2 as a low level (for example, 0 V). In this case, the second potential S2 is not supplied in a period during which the first potential S1 is supplied, and the first potential S1 is not supplied during which the second potential S2 is supplied.

As shown in FIG. 6, the booster circuit 710 preferably periodically varies the common potential Vcom to any one of the low level (for example, 0 V) and the high level (for example, 15 V ) and then supplies the common potential Vcom. Thus, in the display period ST40, for example, common oscillation driving is performed at a frequency of 50 Hz.

The thus supplied high-potential power supply potential VEP, low-potential power supply potential Vss, first potential S1, second potential S2, and the common potential Vcom are supplied to various lines 91, 92, 93, 94 and 95 shown in FIG. 2 through the switches 91*s*, 92*s*, 93*s*, 94*s* and 95*s* that are turned on by the control unit 710. However, in a period during which the first potential S1 is supplied, the first control line 94 is electrically connected through the switch 94*s* to the booster circuit 710, and the second control line 95 is in a high impedance state because the corresponding switch 95*s* is turned off. On the other hand, in a period during which the second potential S2 is supplied, the second control line 95 is electrically connected through the switch 95*s* to the booster circuit 710, and the first control line 94 is in a high impedance state because the corresponding switch 94*s* is turned off.

In the display unit 3, in each pixel 20, a low-level or high-level image signal is held in the memory circuit 25. Thus, in each pixel 20, on the basis of an output (the high-potential power supply potential VEP and the low-potential power supply potential Vss) from the memory circuit 25, one of the first transmission gate 111 and the second transmission gate 112 of the switch circuit 110 is turned on.

Specifically, in each of the pixels 20 to which a low-level image signal is input, only the first transmission gate 111 is turned on, and the pixel electrode 21 is electrically connected to the first control line 94. In addition, in each of the pixels 20 to which a high-level image signal is input, only the second transmission gate 112 is turned on, and the pixel electrode 21 is electrically connected to the second control line 95.

Thus, in each of the pixels 20 to which a low-level image signal is input, the first potential S1 (high level, for example, 15 V ) is supplied from the first control line 94 to the pixel electrode 21, and black color is displayed on the basis of a potential difference that occurs with respect to the common electrode 22 when the common potential Vcom supplied from the common potential line 93 is at a low level (for example, 0 V). On the other hand, in each of the pixels 20 to which a high-level image signal is input, the second potential S2 (low level, for example, 0 V) is supplied from the second control line 95 to the pixel electrode 21, and white color is displayed on the basis of a potential difference that occurs with respect to the common electrode 22 when the common potential Vcom supplied from the common potential line 93 is at a high level (for example, 15 V ).

After that, the sequence ends, and the power supply off period ST50 is initiated. In the power supply off period ST50, again, supply of various power is not performed from the booster circuit 716, and in the pixel 20 shown in FIG. 2, the switches 91*s*, 92*s*, 93*s*, 94*s* and 95*s* are turned off. Thus, the high-potential power supply line 91, the low-potential power supply line 92, the common potential line 93, the first control line 94 and the second control line 95 all are in a high impedance state. Hence, in FIG. 6, the common potential Vcom is also in a high impedance state (Hi-Z), and the control unit 710 preferably enters a standby mode again and, therefore, supply of the control signal is interrupted.

As described above, in the present embodiment, (i) in the image signal writing period ST30 shown in FIG. 6, writing of an image signal to the memory circuit 25 of each pixel 20 is controlled by the control unit 710 on the high-speed clock, and (ii) the operations of display of a deletion image, such as all black or all white, in the deletion periods ST20 and ST21, image display in the display period ST40, start-up from the standby mode in the power supply off period ST10 or ST50 are controlled by the control unit 710 on the low-speed clock.

According to the above described operation example, in regard to the above (i), the plurality of pixels 20 in the display unit 3 shown in FIG. 1 are sequentially selected vertically in units of pixel row arranged horizontally, and in a period during which one of the pixel rows is selected, an image signal is written to each of the pixels that belong to that pixel row. Thus, it is necessary to control the operation on the basis of the high-speed clock in order to quickly perform the above operation. On the other hand, in the above (ii), according to the above described operation example, when a predetermined image is displayed, the first potential S1, the second potential S2 and the common potential Vcom that are common in units of pixel row are supplied respectively through the first control line 94, the second control line 95 and the common potential line 93 to the pixel electrodes 21 and the common electrode 22. Thus, in the above (ii), it is sufficient to control the operation on the basis of the low-speed clock of a frequency lower than that of the above (i). In addition, as other operation included in the above (ii), start-up of the electrophoretic display device from the standby mode, or the like, may also be sufficiently controlled on the basis of the low-speed clock. Note that as described above, common oscillation driving is performed by periodically varying the common potential Vcom in the display period ST40 in a binary manner, and, in this case as well, it is sufficiently controlled on the basis of the low-speed clock.

In addition, in the above (i), by controlling the image signal writing control unit 714 that is separately provided in the driving circuit shown in FIG. 5, the control unit 710 itself does not execute an operation that requires a high-speed clock. Thus, it is sufficient that the control unit 710 is driven on a low-speed clock. Thus, in the present embodiment, it is possible to drive the control unit 710 on the basis of the low-speed clock.

Thus, according to the present embodiment, the control unit 710 avoids control of the above (ii) operation unnecessarily on the basis of the high-speed clock, other than the above (i) that is sufficiently controlled on a low-speed clock. In comparison with the case in which no measures are taken and various control is regularly driven only on the basis of the high-speed clock, it is possible to reduce power consumption. Thus, it is possible to drive the electrophoretic display device at relatively low electric power and, therefore, it is possible to use a simple secondary battery, or the like.

Second Embodiment

An electrophoretic display device according to a second embodiment will be described with reference to FIG. 7 to FIG. 10. Note that the electrophoretic display device according to the second embodiment is an example of a second electrophoretic display device according to the aspects of the invention.

First, the overall configuration of an electrophoretic display panel in an electrophoretic display device according to the present embodiment will be described with reference to FIG. 7 and FIG. 8.

Figure 7:
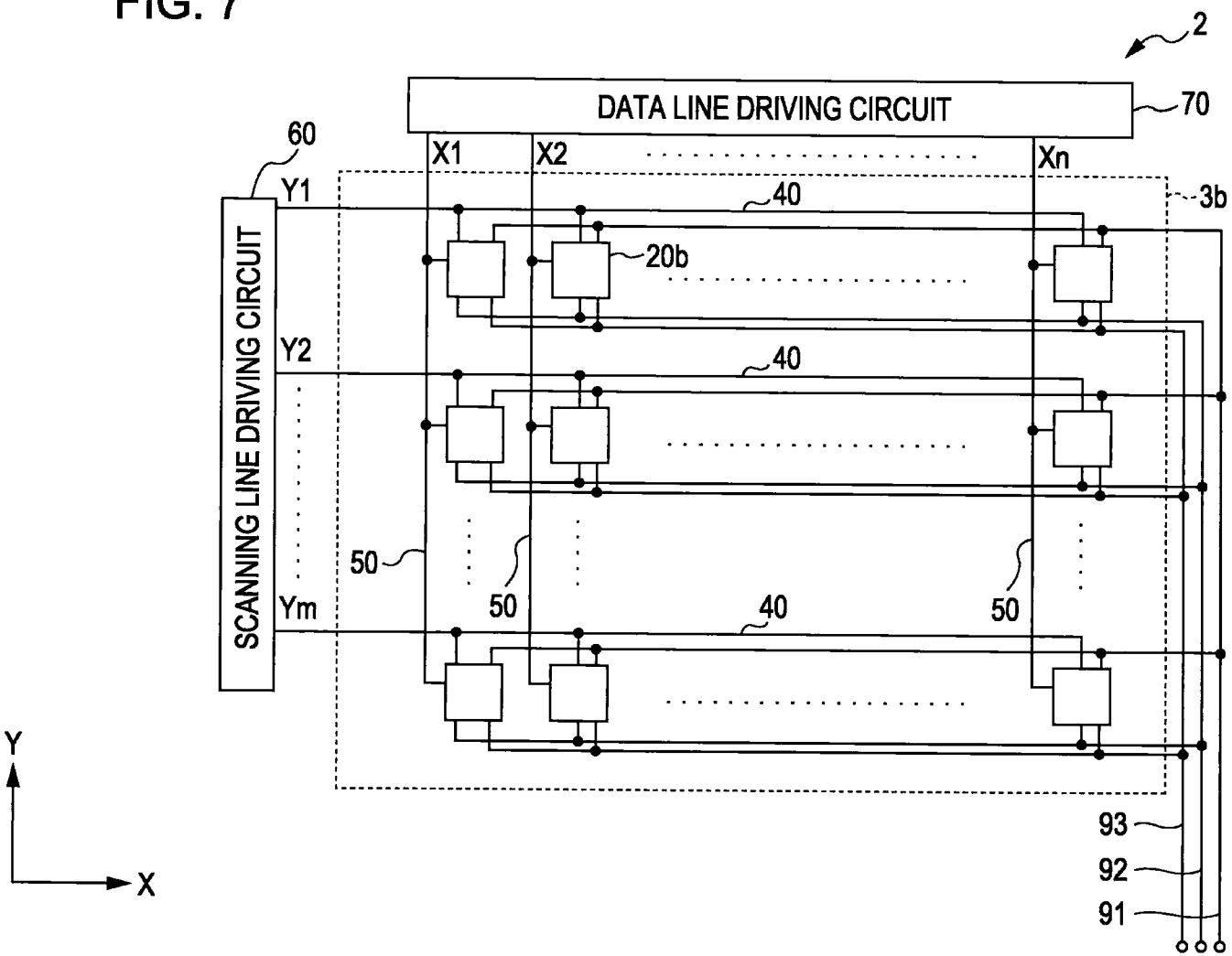
FIG. 7 is a block diagram that shows the overall configuration of an electrophoretic display panel according to a second embodiment.

FIG. 7 is a block diagram that shows the overall configuration of the electrophoretic display panel according to the second embodiment. Note that in FIG. 7, like reference numerals denote like components to those according to the first embodiment shown in FIG. 1 to FIG. 6, and the description thereof is omitted where appropriate. This also applies to FIG. 8 to FIG. 10, which will be described later.

As shown in FIG. 7, the electrophoretic display panel 2 according to the second embodiment includes a display unit 3*b*, the scanning line driving circuit 60 and the data line driving circuit 70 as principal components.

In the display unit 3*b*, pixels 20*b* are arranged in a matrix of m rows and n columns. In addition, m scanning lines 40 and n data lines 50 are provided in the display unit 3*b* so as to intersect with one another. The pixels 20*b* are arranged at positions corresponding to intersections of the m scanning lines 40 and the n data lines 50.

Each pixel 20*b* is electrically connected to the high-potential power supply line 91, the low-potential power supply line 92, and the common potential line 93. The high-potential power supply line 91, the low-potential power supply line 92, and the common potential line 93 each are typically wired commonly to the pixels 20*b* that belong to a pixel column in units of pixel column formed of the pixels 20*b* arranged horizontally (that is, X direction).

Figure 8:
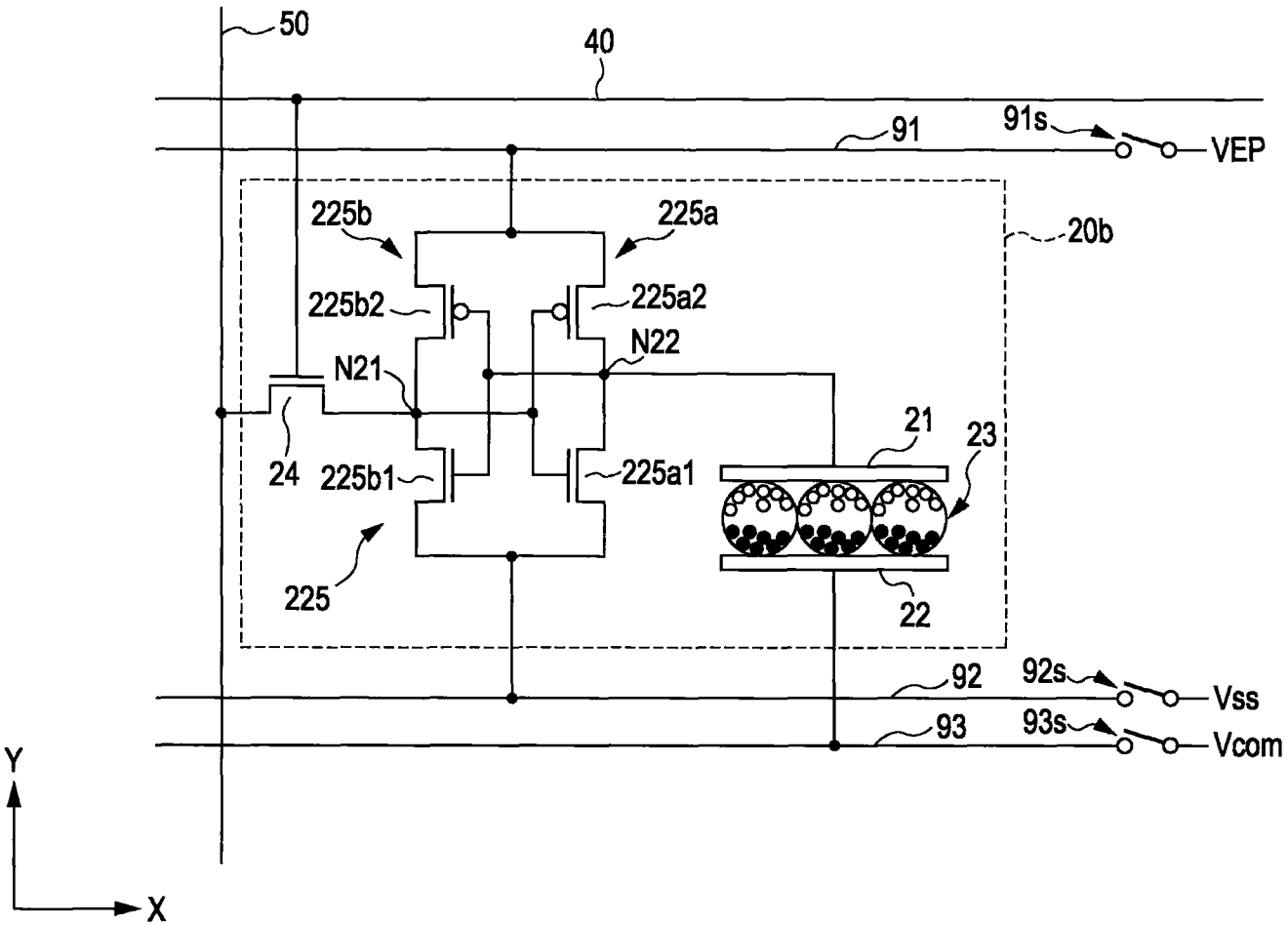
FIG. 8 is an equivalent circuit diagram that shows the electrical configuration of a pixel according to the second embodiment.

FIG. 8 is an equivalent circuit diagram that shows the electrical configuration of a pixel according to the second embodiment.

As shown in FIG. 8, each pixel 20*b* includes the pixel switching transistor 24, which is an example of "pixel switching element" according to the aspects of the invention, a memory circuit 225, the pixel electrode 21, the common electrode 22, and the electrophoretic element 23.

The pixel switching transistor 24 is formed of an N-type transistor. The gate of the pixel switching transistor 24 is electrically connected to the scanning line 40, the source thereof is electrically connected to the data line 50, and the drain thereof is electrically connected to an input terminal N21 of the memory circuit 225. The pixel switching transistor 24 outputs the image signal, supplied from the data line driving circuit 70 (see FIG. 7) through the data line 50, to the input terminal N21 of the memory circuit 225 at the timing based on the scanning signal supplied in a pulse-like manner from the scanning line driving circuit 60 (see FIG. 7) through the scanning line 40.

The memory circuit 225 includes inverter circuits 225*a* and 225*b*, and is formed as an SRAM.

The inverter circuits 225*a* and 225*b* forms a loop structure such that the input terminals are connected to the output terminals of the other one. That is, the input terminal of the inverter circuit 225*a* is electrically connected to the output terminal of the inverter circuit 225*b*, and the input terminal of the inverter circuit 225*b* is electrically connected to the output terminal of the inverter circuit 225*a*. The input terminal of the inverter circuit 225*a* is formed as the input terminal N21 of the memory circuit 225. The output terminal of the inverter circuit 225*a* is formed as the output terminal N22 of the memory circuit 225.

The inverter circuit 225*a* has an N-type transistor 225*a*1 and a P-type transistor 225*a*2. The gates of the N-type transistor 225*a*1 and P-type transistor 225*a*2 are electrically connected to the input terminal N21 of the memory circuit 225. The source of the N-type transistor 225*a*1 is electrically connected to the low-potential power supply line 92 to which a low-potential power supply potential Vss is supplied. The source of the P-type transistor 225*a*2 is electrically connected to the high-potential power supply line 91 to which a high-potential power supply potential VEP is supplied. The drains of the N-type transistor 225*a*1 and P-type transistor 225*a*2 are electrically connected to the output terminal N22 of the memory circuit 225.

The inverter circuit 225*b* has an N-type transistor 225*b*1 and a P-type transistor 225*b*2. The gates of the N-type transistor 225*b*1 and P-type transistor 225*b*2 are electrically connected to the output terminal N22 of the memory circuit 225. The source of the N-type transistor 225*b*1 is electrically connected to the low-potential power supply line 92. The source of the P-type transistor 225*b*2 is electrically connected to the high-potential power supply line 91. The drains of the N-type transistor 225*b*1 and P-type transistor 225*b*2 are electrically connected to the input terminal N21 of the memory circuit 225.

When a high-level image signal is input to the input terminal N21 of the memory circuit 225, the memory circuit 225 outputs the low-potential power supply potential Vss from the output terminal N22. When a low-level image signal is input to the input terminal N21 of the memory circuit 225, the memory circuit 225 outputs the high-potential power supply potential VEP from the output terminal N22. That is, the memory circuit 225 is able to store the input image signal as the low-potential power supply potential Vss or the high-potential power supply potential VEP. The output terminal N22 of the memory circuit 225 is electrically connected to the pixel electrode 21. Thus, each pixel electrode 21 is supplied from the memory circuit 225 with the low-potential power supply potential Vss or the high-potential power supply potential VEP on the basis of the image signal stored (in other words, written) in the memory circuit 225. That is, the memory circuit 225 is able to write an image signal through the pixel switching transistor 24 (in other words, store an image signal supplied through the pixel switching transistor 24), and is able to supply the pixel electrode 21 with the low-potential power supply potential Vss or the high-potential power supply potential VEP as a predetermined pixel potential on the basis of the written (or stored) image signal.

Next, a driving circuit for driving the above described electrophoretic display panel 2 will be described with reference to FIG. 9.

Figure 9:
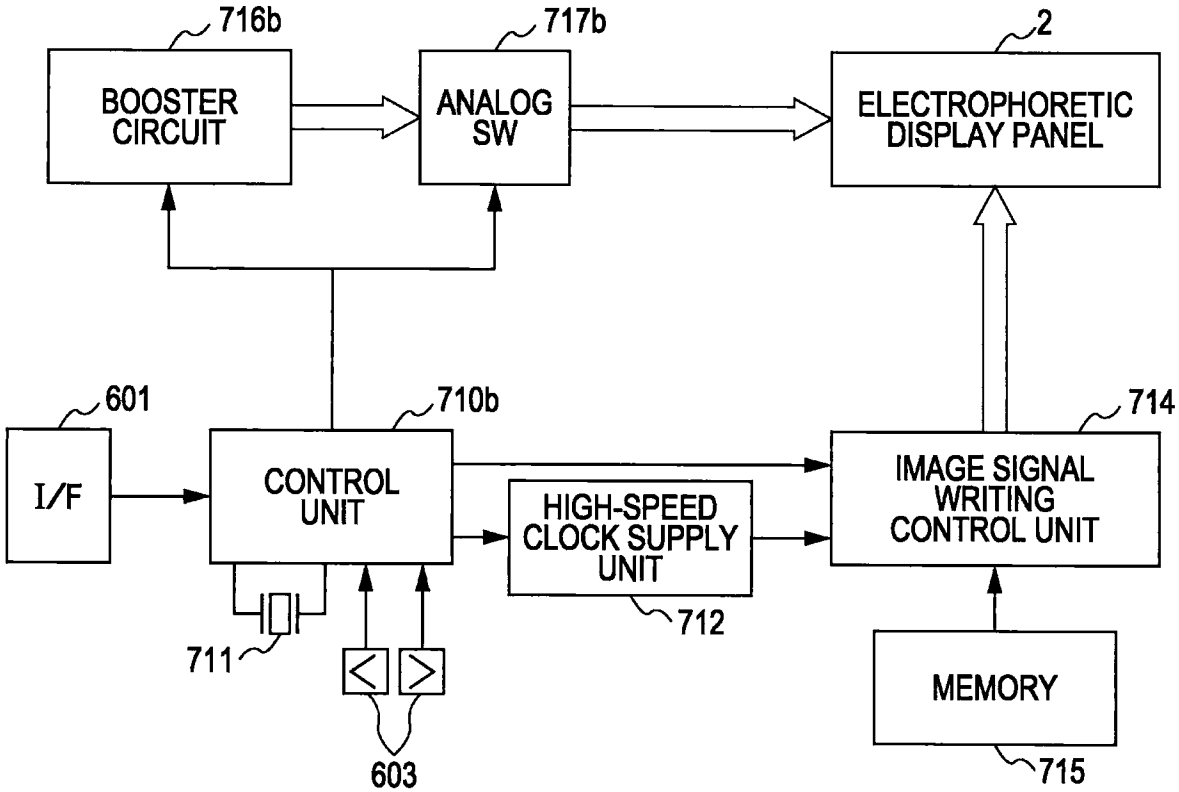
FIG. 9 is a block diagram that schematically shows the configuration of a driving circuit that drives the electrophoretic display panel according to the second embodiment.

FIG. 9 is a block diagram that schematically shows the configuration of the driving circuit that drives the electrophoretic display panel according to the second embodiment.

As shown in FIG. 9, the driving circuit according to the second embodiment includes a control unit 710*b* that includes a controller, the low-speed clock supply unit 711, the high-speed clock supply unit 712, the image signal writing control unit 714, the memory 715, a booster circuit 716*b* and an analog switch (Analog SW) 717*b*, as its principal components. The electrophoretic display device according to the second embodiment includes the driving circuit and the electrophoretic display panel 2 as its principal configuration.

The control unit 710*b* controls driving of the electrophoretic display panel 2, and controls the high-speed clock supply unit 712, the image signal writing control unit 714, the memory 715, and operations of the booster circuit 716*b* and the analog switch 717*b*. Alternatively, the control unit 710*b* recognizes an instruction through the external interface (I/F) 601 via, for example, USB outside the electrophoretic display device, key input to the next page or previous page buttons 603 as a UI, or the like, and then starts up the driving circuit and/or the electrophoretic display panel 2, manages the temperature of the electrophoretic display device, or the like.

The booster circuit 716*b* is able to supply various power source for driving the electrophoretic display panel 2 through the analog switch 717*b*. Note that the booster circuit 716*b* and the analog switch 717*b* constitute an example of "power supply unit" according to the aspects of the invention.

As shown in FIG. 7 to FIG. 9, the booster circuit 716*b* supplies the high-potential power supply line 91 with the high-potential power supply potential VEP, supplies the low-potential power supply line 92 with the low-potential power supply potential Vss, and supplies the common potential line 93 with the common potential Vcom, In addition, the booster circuit 716*b* supplies power source for driving the scanning line driving circuit 60, the data line driving circuit 70, and the like.

The analog switch 717*b* includes three types of switches 91*s*, 92*s* and 93*s* shown in FIG. 8. The high-potential power supply potential VEP is supplied through the switch 91*s* to the high-potential power supply line 91. Similarly, the low-potential power supply potential Vss and the common potential Vcom are supplied respectively through the switches 92*s* and 93*s* to the low-potential power supply line 92 and the common potential line 93. Each of the three types of switches 91*s*, 92*s* and 93*s* may be switched between an on state and an off state by the control unit 710*b*. When the switch 91*s* turns on, the high-potential power supply line 91 is electrically connected to the booster circuit 716*b*. When the switch 91*s* turns off, the high-potential power supply line 91 is electrically disconnected to enter a high impedance state. Similarly, when one of the switches 92*s* and 93*s* turns on, a corresponding one of the low-potential power supply line 92 and the common potential line 93 is connected to the booster circuit 716*b*. When one of the switches turns off, a corresponding one of the low-potential power supply line 92 and the common potential line 93 enters a high impedance state.

Next, the display operation in the electrophoretic display device according to the second embodiment will be described with reference to FIG. 10.

Figure 10:
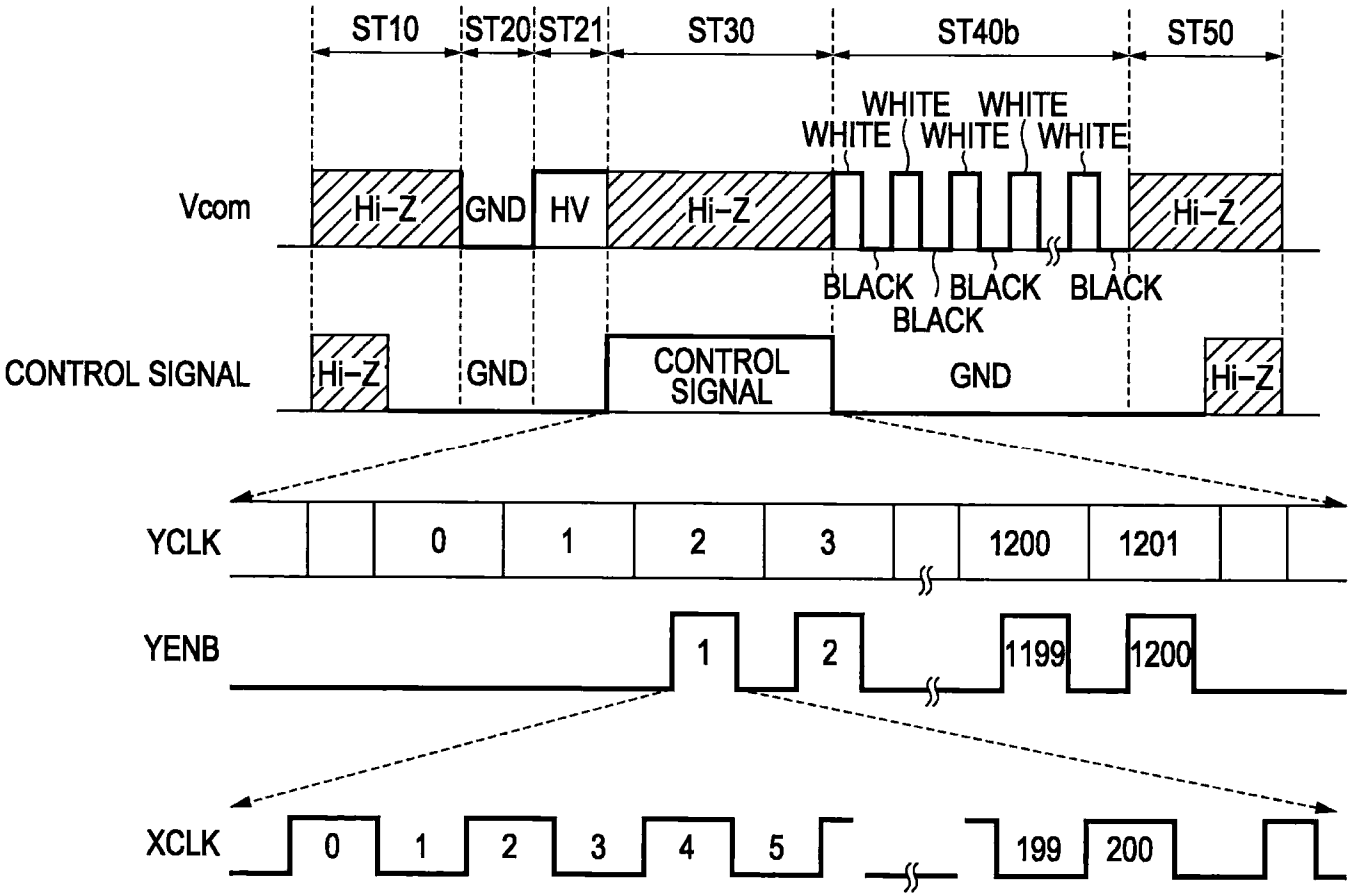
FIG. 10 is a timing chart that illustrates a display operation in the electrophoretic display device according to the second embodiment.

FIG. 10 is a timing chart that illustrates the display operation in the electrophoretic display device according to the second embodiment.

As shown in FIG. 10, in the second embodiment, after the power supply off period ST10 before starting the sequence according to the display operation, during the deletion periods ST20 and ST21 a previous image is deleted. After that, in each pixel 20 (see FIG. 1 and FIG. 2), after the image signal writing period ST 30 during which an image signal is written, during a display period ST40*b* a voltage is applied between the pixel electrode 21 and the common electrode 22 to display an image on the display unit 3*b*. Then, a series of operations ends and enters again to the power supply off period ST50.

FIG. 10 shows the common potential Vcom, a control signal from the control unit 710*b* (see FIG. 9) to the image signal writing control unit 714, and various timing signals supplied from the image signal writing control unit 714 on the basis of the control signal to the data line driving circuit 70 and the scanning line driving circuit 60 (see FIG. 7).

In the second embodiment, as almost similarly in the case of the above described first embodiment, (i) in the image signal writing period ST30 shown in FIG. 10, writing of an image signal to the memory circuit 225 of each pixel 20*b* is controlled by the control unit 710*b* on the high-speed clock, and (ii) the operations of display of a deletion image, such as all black or all white, in the deletion periods ST20 and ST21, image display in the display period ST40*b*, start-up from the standby mode in the power supply off period ST10 or ST50 are controlled by the control unit 710*b* on the low-speed clock.

Specifically, in FIG. 9 and FIG. 10, in a period from the middle of the power supply off period ST10 before the sequence to the deletion periods ST20 and ST21, the control signal from the control unit 710*b* is maintained at a low level (for example, 0 V, which is a ground potential (GND)). After that, when the image signal writing period ST30 is initiated, the control signal from the control unit 710*b* attains a high level. Thus, the image signal writing control unit 714 is started up, and the high-speed clock is supplied from the high-speed clock supply unit 712 to the image signal writing control unit 714. The image signal writing control unit 714 reads a sequence according to the image signal writing operation from the memory 715, and executes the sequence on the basis of the high-speed clock. At the end of the image signal writing period ST30, each pixel 20*b* enters a state in which a low-level or high-level image signal is written (or held) in the memory circuit 225.

Subsequently, the display period ST40*b* is initiated. The control signal from the control unit 710*b* attains a low level as shown in FIG. 10, supply of the high-speed clock from the high-speed clock supply unit 712 is interrupted, and the operation of the image signal writing control unit 714 is also interrupted. Driving of the booster circuit 716*b* and the analog switch 717*b* is controlled by the control unit 710*b* on the basis of the low-speed clock.

During the display period ST40*b*, the booster circuit 716*b* supplies the high-level high-potential power supply potential VEP (for example, 15 V ) and the low-level low-potential power supply potential Vss (for example, 0 V). In addition, the booster circuit 710*b* periodically varies the common potential Vcom to any one of the low level (for example, 0 V) and the high level (for example, 15 V ) and then supplies the common potential Vcom. Thus, in the display period ST40*b*, for example, common oscillation driving is performed at a frequency of 50 Hz. That is, in each of the pixels 20*b* to which a high-level image signal is written to the memory circuit 225 in the image signal writing period ST30, the low-potential power supply potential Vss (for example, 0 V) is supplied from the memory circuit 225 to the pixel electrode 21 during the display period ST40*b*, and white color is displayed on the basis of a potential difference that occurs with respect to the common electrode 22 when the common potential Vcom supplied from the common potential line 93 is at a high level (for example, 15 V ). On the other hand, in each of the pixels 20*b* to which a low-level image signal is written to the memory circuit 225 in the image signal writing period ST30, the high-potential power supply potential VEP (for example, 15 V) is supplied from the memory circuit 225 to the pixel electrode 21 during the display period ST40*b*, and black color is displayed on the basis of a potential difference that occurs with respect to the common electrode 22 when the common potential Vcom supplied from the common potential line 93 is at a low level (for example, 0 V). [00157] After that, the sequence ends, and the power supply off period ST50 is initiated. In the power supply off period ST50, again, supply of various power is not performed from the booster circuit 716*b*, and, in each pixel 20*b*, the switches 91*s*, 92*s* and 93*s* are turned off.

As described above, according to the second embodiment, the control unit 710*b* avoids unnecessary control of the operations of display of a deletion image, such as all black or all white, in the deletion periods ST20 and ST21, image display in the display period ST40*b*, start-up from the standby mode in the power supply off period ST10 or ST50, which are sufficiently controlled on the low-speed clock (in other words, operations other than the writing operation of the image signal to the memory circuit 225, which requires high-speed clock). In comparison with the case in which no measures are taken and various control is regularly driven only on the basis of the high-speed clock, it is possible to reduce power consumption. Thus, according to the second embodiment, as in the case of the above described first embodiment, it is possible to drive the electrophoretic display device at relatively low electric power and, therefore, it is possible to use a simple secondary battery, or the like.

Electronic Apparatus

Next, electronic apparatuses that employ the above described electrophoretic display device will be described with reference to FIG. 11 and FIG. 12. Hereinafter, an example in which the above described electrophoretic display device is applied to an electronic paper and an electronic notebook will be described.

Figure 11:
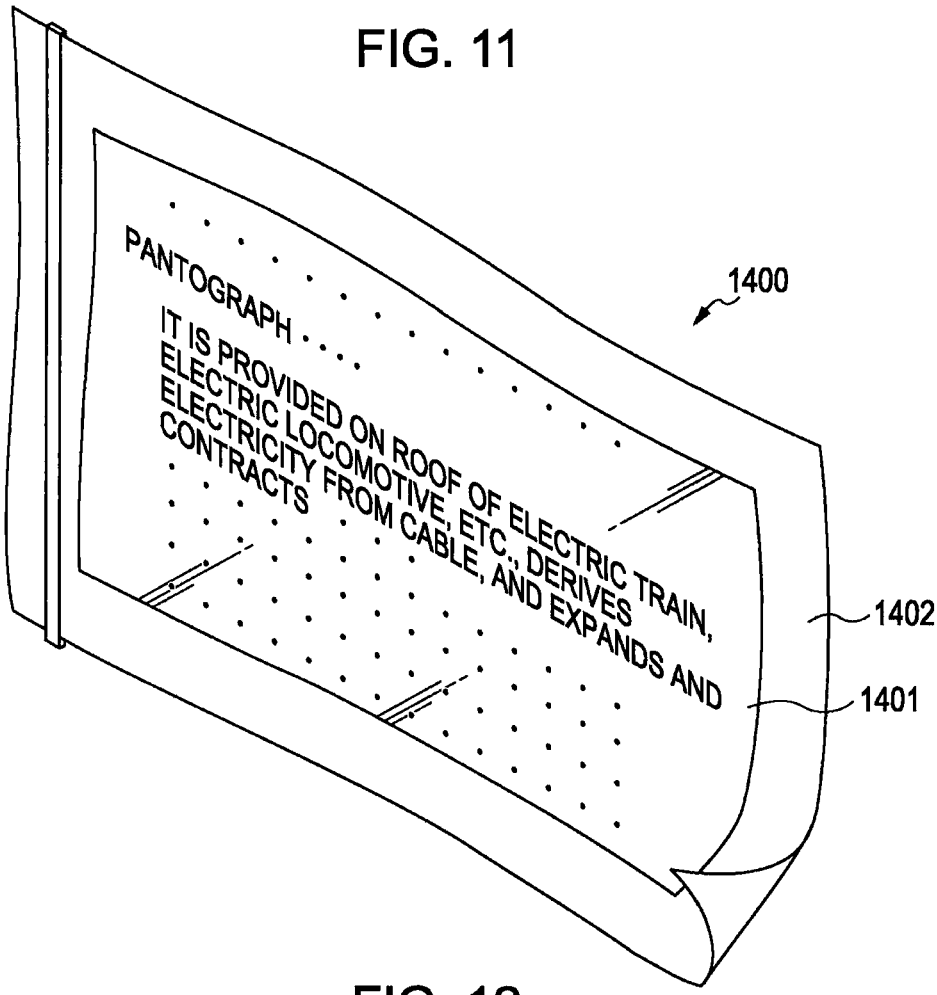
FIG. 11 is a perspective view that shows the configuration of an electronic paper, which is an example of an electronic apparatus to which an electrophoretic display device is applied.

FIG. 11 is a perspective view that shows the configuration of an electronic paper 1400.

As shown in FIG. 11, the electronic paper 1400 includes the electrophoretic display device according to the above described embodiments as a display unit 1401. The electronic paper 1400 is flexible and has a body 1402 formed of a rewritable sheet having a texture and flexibility similar to an existing paper.

Figure 12:
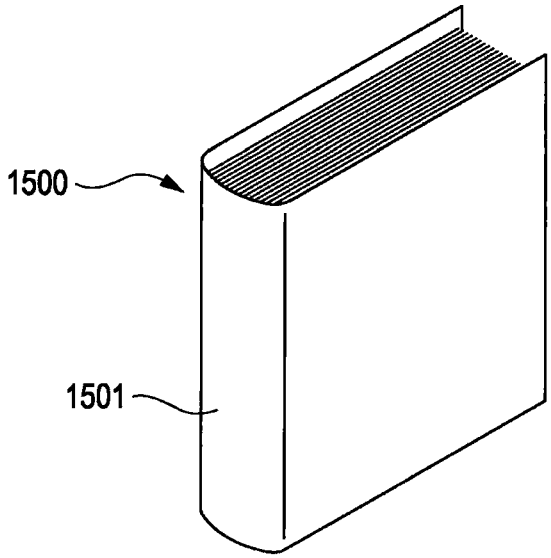
FIG. 12 is a perspective view that shows the configuration of an electronic notebook, which is an example of an electronic apparatus to which an electrophoretic display device is applied.

FIG. 12 is a perspective view that shows the configuration of an electronic notebook 1500.

As shown in FIG. 12, the electronic notebook 1500 is configured so that the multiple sheets of electronic paper 1400 shown in FIG. 11 are bound and fastened with a cover 1501. The cover 1501 is provided with a display data input device (not shown) that is used to input display data sent from, for example, an external device. Thus, in accordance with the display data, it is possible to change or update the contents of display while the electronic papers are bound.

Because the above described electronic paper 1400 and electronic notebook 1500 each include the electrophoretic display device according to the above described embodiments, power consumption is small, and it is possible to perform high-quality image display.

Note that, other than the above, the display unit of an electronic apparatus, such as a watch, a cellular phone, or a portable audio device, may employ the electrophoretic display device according to the above described embodiments.

The aspects of the invention are not limited to the embodiments described above; they may be modified appropriately without departing from the scope or spirit of the invention that can be read from the appended claims and entire specifications. The aspects of the invention also encompass the thus modified electrophoretic display device driving circuit, electrophoretic display device, and electronic apparatus provided with the electrophoretic display device.

The entire disclosure of Japanese Patent Application Nos: 2008-070080, filed Mar. 18, 2008 and 2008-273105, filed Oct. 23, 2008 are expressly incorporated by reference herein.

What is claimed is:

1. An electrophoretic display device driving circuit that drives an electrophoretic display device that includes a display unit having a plurality of pixels, each of the plurality of pixels including:

an electrophoretic element, containing electrophoretic particles, that is provided between a pixel electrode and a common electrode that face each other;

a pixel switching element;

a memory circuit to which an image signal may be written through the pixel switching element; and a switch circuit that controls switching of the pixel electrode in accordance with an output based on the image signal in the memory circuit, the electrophoretic display device driving circuit comprising:

a low-speed clock supply unit that supplies a low-speed clock;

a high-speed clock supply unit that supplies a high-speed clock having a frequency higher than that of the low-speed clock; and a control unit, the control unit controlling writing of the image signal to the memory circuit on the basis of the high-speed clock when changing images, and controlling supply of a predetermined pixel potential to the pixel electrode through the switching control on the basis of the low-speed clock during a stand-by mode when images are not being changed.

2. The electrophoretic display device driving circuit according to claim 1, further comprising:

a power supply unit that supplies the pixel potential to the display unit and that supplies a common potential to the common electrode in synchronization with the supply of the pixel potential, wherein the control unit controls supply of the pixel potential and the common potential by the power supply unit on the basis of the low-speed clock.

3. The electrophoretic display device driving circuit according to claim 2, wherein the power supply unit varies the common potential to any one of a low potential level and a high potential level having a potential higher than the low potential level and then supplies the common potential.

4. The electrophoretic display device driving circuit according to claim 1, further comprising:

a memory writing execution unit that executes writing of the image signal to the memory circuit, wherein the control unit controls both the high-speed clock supply unit and the memory writing execution unit.

5. An electrophoretic display device comprising:

a display unit that includes a plurality of pixels, each of the plurality of pixels including:

an electrophoretic element, containing electrophoretic particles, that is provided between a pixel electrode and a common electrode that face each other;

a pixel switching element;

a memory circuit to which an image signal may be written through the pixel switching element; and a switch circuit that controls switching of the pixel electrode in accordance with an output based on the image signal in the memory circuit;

a low-speed clock supply unit that supplies a low-speed clock;

a high-speed clock supply unit that supplies a high-speed clock having a frequency higher than that of the low-speed clock; and a control unit, the control unit controlling writing of the image signal to the memory circuit on the basis of the high-speed clock when changing images, and controlling supply of a predetermined pixel potential to the pixel electrode through the switching control on the basis of the low-speed clock during a stand-by mode when images are not being changed.

6. An electronic apparatus comprising the electrophoretic display device according to claim 5.

7. An electrophoretic display device driving circuit that drives an electrophoretic display device that includes a display unit having a plurality of pixels, each of the plurality of pixels including:

an electrophoretic element, containing electrophoretic particles, that is provided between a pixel electrode and a common electrode that face each other;

a pixel switching element; and a memory circuit to which an image signal may be written through the pixel switching element and which is able to supply a predetermined pixel potential to the pixel electrode in accordance with the written image signal, the electrophoretic display device driving circuit comprising:

a low-speed clock supply unit that supplies a low-speed clock;

a high-speed clock supply unit that supplies a high-speed clock having a frequency higher than that of the low-speed clock; and a control unit, the control unit controlling writing of the image signal to the memory circuit on the basis of the high-speed clock when changing images, and controlling supply of a predetermined pixel potential to the pixel electrode through the switching control on the basis of the low-speed clock during a stand-by mode when images are not being changed.

8. The electrophoretic display device driving circuit according to claim 7, further comprising:

a power supply unit that supplies the pixel potential to the display unit and that supplies a common potential to the common electrode in synchronization with the supply of the pixel potential, wherein the control unit controls supply of the pixel potential and the common potential by the power supply unit on the basis of the low-speed clock.

9. The electrophoretic display device driving circuit according to claim 8, wherein the power supply unit varies the common potential to any one of a low potential level and a high potential level having a potential higher than that of the low potential level and then supplies the common potential.

10. The electrophoretic display device driving circuit according to claim 7, further comprising:

a memory writing execution unit that executes writing of the image signal to the memory circuit, wherein the control unit controls both the high-speed clock supply unit and the memory writing execution unit.

11. An electrophoretic display device comprising the electrohoretic display device driving circuit according to claim 7.

* * * * *